US008985730B2

(12) United States Patent
Gotschewski

(10) Patent No.: US 8,985,730 B2
(45) Date of Patent: Mar. 24, 2015

(54) MEDIA PROCESSING DEVICE WITH ENHANCED MEDIA AND RIBBON LOADING AND UNLOADING FEATURES

(71) Applicant: ZIH Corp., Lincolnshire, IL (US)

(72) Inventor: Robert P. Gotschewski, Schaumburg, IL (US)

(73) Assignee: ZIH Corp., Lincolnshire, IL (US)

( * ) Notice: Subject to any disclaimer, the term of this patent is extended or adjusted under 35 U.S.C. 154(b) by 10 days.

(21) Appl. No.: 13/671,214

(22) Filed: Nov. 7, 2012

(65) Prior Publication Data

US 2013/0113858 A1 May 9, 2013

Related U.S. Application Data

(60) Provisional application No. 61/556,644, filed on Nov. 7, 2011.

(51) Int. Cl.

| | |
|---|---|
| ***B41J 29/38*** | (2006.01) |
| ***B41J 2/32*** | (2006.01) |
| ***B41J 2/315*** | (2006.01) |
| ***B41J 25/312*** | (2006.01) |
| ***B41J 11/20*** | (2006.01) |
| ***B41J 29/13*** | (2006.01) |

(52) U.S. Cl.

CPC ..... *B41J 25/312* (2013.01); *B41J 11/20* (2013.01); *B41J 29/13* (2013.01)

USPC ..... 347/17; 347/198; 400/120.17

(58) Field of Classification Search

USPC ..... 347/17, 104, 197, 198; 400/120.17, 320

See application file for complete search history.

(56) References Cited

U.S. PATENT DOCUMENTS

| | | | |
|---|---|---|---|
| 4,151,397 | A | 4/1979 | Boor et al. |
| 4,708,500 | A | 11/1987 | Bangs et al. |
| 5,064,300 | A | 11/1991 | Kashiwaba |
| 5,206,662 | A | 4/1993 | Fox et al. |
| 5,379,056 | A | 1/1995 | Walter et al. |

(Continued)

FOREIGN PATENT DOCUMENTS

| | | |
|---|---|---|
| EP | 0361826 | 4/1990 |
| GB | 2227460 | 8/1990 |

(Continued)

OTHER PUBLICATIONS

International Search Report and Written Opinion of the Searching Authority for Application No. PCT/US2012/063900; dated Jan. 28, 2013.

*Primary Examiner* — Jannelle M Lebron

(74) *Attorney, Agent, or Firm* — Alston & Bird LLP

(57) ABSTRACT

A device for processing media may include a printhead pressure adjustment assembly including a barrel and a biasing element configured to apply a biasing force to the printhead, where the biasing force may be adjustable in response to the barrel being rotated about its axis. The printhead pressure adjustment assembly may further include a threaded insert received within the barrel and configured to move axially within the barrel in response to the barrel being rotated. The printhead pressure adjustment assembly may further include a cup received within the barrel and attached to the biasing element. The adjustment assembly may include a spring disposed between the threaded insert and the cup, where the spring is compressed in response to the barrel being rotated in a first direction and the spring is decompressed in response to the spring being rotated in a second direction.

19 Claims, 18 Drawing Sheets

(56) References Cited

U.S. PATENT DOCUMENTS

| | | | | |
|---|---|---|---|---|
| 5,448,281 | A | 9/1995 | Walter et al. | |
| 5,528,277 | A | 6/1996 | Nardone et al. | |
| 5,555,009 | A | 9/1996 | Hevenor et al. | |
| 5,594,487 | A | 1/1997 | Nuita et al. | |
| 5,612,727 | A | 3/1997 | Morimoto et al. | |
| 5,638,106 | A | 6/1997 | Nierescher | |
| 5,678,938 | A | 10/1997 | Saito et al. | |
| 5,735,617 | A | 4/1998 | Wirth | |
| 5,918,990 | A | 7/1999 | Abumehdi | |
| 5,947,818 | A | 9/1999 | Satzler | |
| 6,031,599 | A | 2/2000 | Sheng et al. | |
| 6,059,468 | A | 5/2000 | Haug | |
| 6,400,387 | B1 | 6/2002 | Kerr | |
| 6,406,200 | B2 * | 6/2002 | Mahoney | 400/120.17 |
| 6,549,224 | B2 | 4/2003 | Connor | |
| 6,937,260 | B2 | 8/2005 | Williams et al. | |
| 6,940,533 | B2 | 9/2005 | Burdenko | |
| 6,975,341 | B2 | 12/2005 | Connor et al. | |
| 6,977,669 | B2 | 12/2005 | Shih et al. | |
| 7,222,934 | B2 | 5/2007 | Williams | |
| 7,273,323 | B2 | 9/2007 | Troman | |
| 7,448,736 | B2 | 11/2008 | Hong et al. | |
| 7,576,761 | B2 | 8/2009 | Suzuki et al. | |
| 2003/0146968 | A1 | 8/2003 | Milton | |
| 2011/0250000 | A1 * | 10/2011 | Anderson et al. | 400/578 |
| 2012/0026268 | A1 | 2/2012 | Watson et al. | |

FOREIGN PATENT DOCUMENTS

| | | | |
|---|---|---|---|
| GB | 2 250 717 | A | 6/1992 |
| GB | 2 293 576 | A | 4/1996 |
| GB | 2 294 907 | A | 5/1996 |
| WO | WO 92/17341 | | 10/1992 |

* cited by examiner

MEDIA PROCESSING DEVICE WITH ENHANCED MEDIA AND RIBBON LOADING AND UNLOADING FEATURES

BACKGROUND OF THE INVENTION

Various embodiments of the invention are directed to printers and other systems for processing media including labels, receipt media, cards, and the like. Applicant has identified a number of deficiencies and problems associated with the manufacture, use, and maintenance of conventional printers. Through applied effort, ingenuity, and innovation, Applicant has solved many of these identified problems by developing a solution that is embodied by the present invention, which is described in detail below.

BRIEF SUMMARY

Various embodiments of the present invention are directed to a system and method for applying pressure to a printhead of a printer. Example embodiments may provide a system that allows for pressure to be adjustable and variable along the length of the printhead. Such embodiments are configured to improve print quality by ensuring consistent printing along the length of a printhead.

Example embodiments of the present invention are directed to a printhead pressure adjustment assembly including a barrel configured to rotate about an axis and a biasing element received within the barrel and configured to apply a biasing force generally along the axis to a printhead. The biasing force applied to the printhead may be adjustable in response to the barrel being rotated. The assembly may further include a threaded insert received within the barrel, the threaded insert including external threads configured to engage reciprocally configured internal threads defined by the barrel to translate the threaded insert generally along the axis within the barrel in response to the barrel being rotated. The assembly may further include a cup received within the barrel and attached to the biasing element. A spring may be disposed between the threaded insert and the cup, where the spring is compressed in response to the barrel being rotated in a first direction and the spring is decompressed in response to the barrel being rotated in a second direction, opposite the first direction.

The printhead pressure adjustment assembly of some embodiments may further include a spring configured to be compressed between the biasing element and the threaded insert, where the spring applies the biasing force to the biasing element, where the spring is compressed in response to the barrel being rotated in a first direction, and the spring is decompressed in response to the barrel being rotated in a second direction, opposite the first direction. The biasing force may be increased in response to the spring being compressed and the biasing force may be decreased in response to the spring being decompressed. The adjustment assembly may be supported by a toggle assembly and the toggle assembly may be configured to be toggled between an engaged position and a disengaged position. The biasing force may be configured to be adjustable between about 3.5 pounds-force and about 9.3 pounds-force. The printhead pressure adjustment assembly of some embodiments may include a spring disposed within the barrel and configured to apply the biasing force to the biasing element. The barrel may include biasing force level demarcations arranged around a perimeter of the barrel for reference by a user during biasing force adjustment.

Embodiments of the present invention may include a printhead pressure adjustment assembly including a barrel defining an internally threaded bore, a threaded insert disposed within the barrel, where the threaded insert defines an external thread configured to engage the internally threaded bore of the barrel, a biasing element configured to apply a biasing force to a printhead, and a spring coupled to the threaded insert. The spring may be compressed, increasing the biasing force in response to the barrel being rotated in a first direction and the spring may be decompressed, decreasing the biasing force, in response to the barrel being rotated in a second direction, opposite the first direction.

According to some embodiments, the threaded insert may be configured to remain rotationally fixed as the barrel is rotated. The biasing force may be configured to be adjustable between about 3.5 pounds-force and about 9.3 pounds-force. The printhead pressure adjustment assembly may be configured to be rotated between an engaged position in which the biasing element is engaged with a printhead, and a disengaged position in which the biasing element is disengaged within the printhead. The printhead pressure adjustment assembly of some embodiments may include a base plate configured to retain the biasing element within the barrel in response to the printhead pressure adjustment assembly being moved to the disengaged position. Embodiments may include a friction element configured to provide a friction force to resist rotation of the barrel. The barrel may include an external rotation stop configured to limit rotation of the barrel to less than 360 degrees.

Embodiments of the present invention may include a printer including a printhead assembly and a printhead pressure adjustment assembly configured to apply pressure to the printhead assembly. The printhead pressure adjustment assembly may include an internally threaded barrel configured to rotate about an axis, wherein the barrel includes biasing pressure level demarcations arranged around a perimeter of the barrel. The printhead pressure adjustment assembly may further include a threaded insert including external threads that are configured to engage the internal threads of the barrel, a biasing element received within the barrel and configured to apply a biasing force generally along the axis to the printhead assembly, wherein the biasing force applied to the printhead is adjustable in response to the barrel being rotated, and a spring arranged to apply the biasing force to the biasing element. The spring of some embodiments may be compressed and the biasing force increased in response to the barrel being rotated in a first direction, and the spring may be decompressed and the biasing force is decreased in response to the barrel being rotated in a second direction, opposite the first direction. The printhead pressure adjustment assembly of some embodiments may be configured to toggle between an engaged position in which the printhead pressure adjustment assembly applies a pressure to the printhead assembly, and a disengaged position in which the printhead pressure adjustment assembly does not apply pressure to the printhead assembly.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Printers and media processing devices may be configured to print and/or encode media drawn from a roll or spool. Such media may include a web supporting a plurality of individually cut media components, such as adhesive-backed and carrier-supported labels, or the media may be a continuous web such as a spool of linerless label media or direct thermal tag stock. Printers process (e.g., print, encode, etc.) the media by drawing the media from the spool and routing the media proximate various processing components (e.g., printhead, RFID reader/encoder, magnetic stripe reader/encoder etc.). Processing the media from a spool may facilitate a continuous or batch printing process.

From time to time, printers exhaust the available supply of media such that a user must replace the media supply spool. Other consumables such as ribbon, printheads, and the like must also be periodically replaced. Once such consumables have been replaced, it is important that they be positioned/routed efficiently and precisely to ensure limited downtime and proper print quality.

Embodiments of the present invention are directed to an improved media processing device that is structured to enhance user serviceability, simplify printhead alignment, and ease media routing. Such embodiments are configured to provide these advantages while maintaining a compact size footprint.

Figure 1:
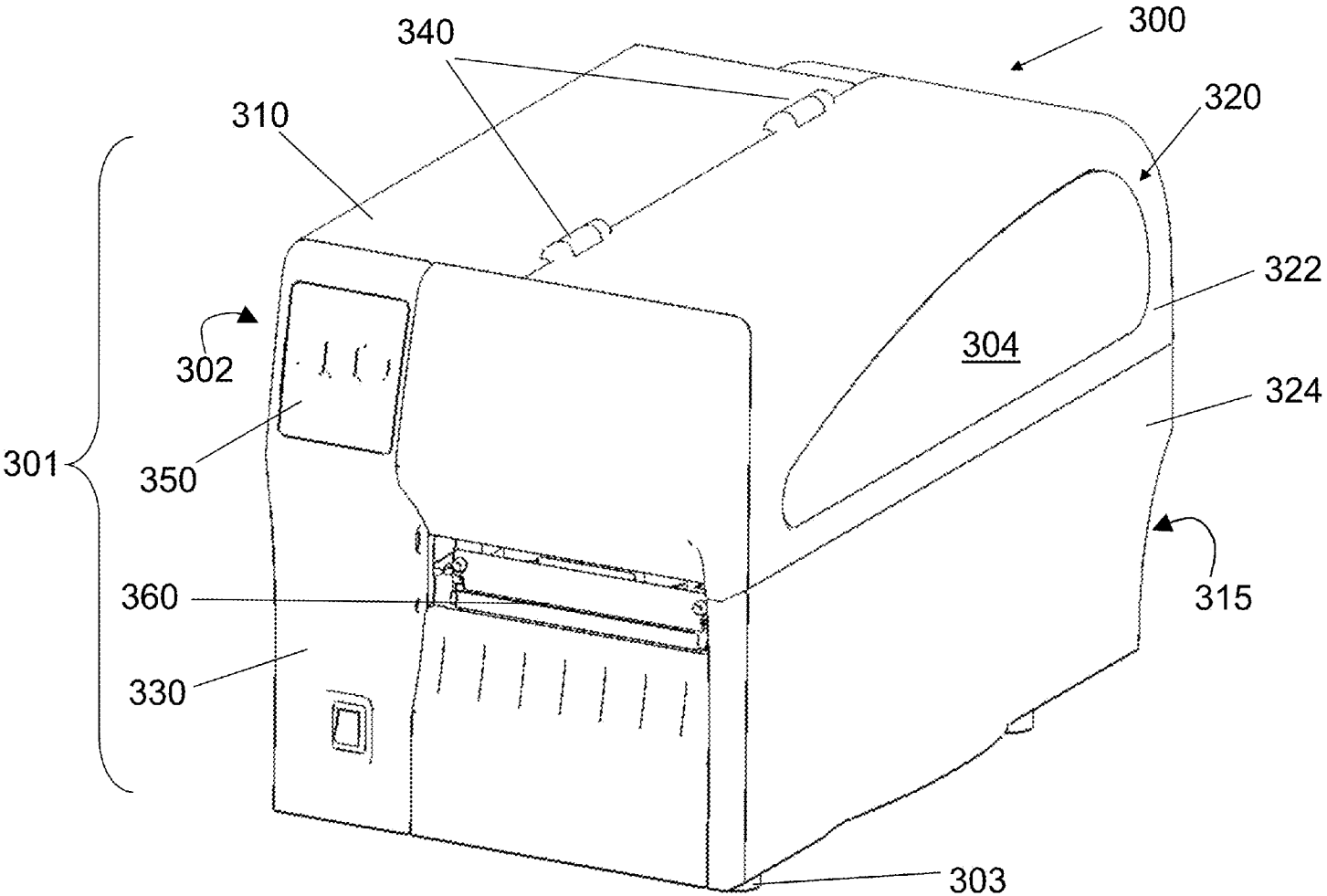
FIG. 1 illustrates a media processing device according to example embodiments of the present invention.

FIG. 1 illustrates a printer or processing device according to example embodiments of the present invention. While the illustrated embodiments and description provided herein are directed primarily to a printing device, other media processing devices such as media encoders or laminators, may benefit from the mechanisms described. Further, an example embodiment of the present invention may provide printing, encoding, and/or laminating functionality in a single device.

The printer 300 of FIG. 1 includes a housing 301 and a base 303. The housing 301 may include a front panel 330, a rear panel 315, a side panel 302, and a support surface 310. The housing may include a user interface 350 and a media exit 360. The media exit may be arranged in the front panel 330 of the printer 300 and may be configured to expel media after it has been processed. The housing may further include an access door assembly 320 comprising a major door 322 and a minor door 324. The major door 322 may be hingedly attached to the support surface 310 with hinges 340 and the minor door 324 may be hingedly attached to the major door 322. The access door assembly 320 of FIG. 1 is illustrated in the closed, operational position in which access to the internal components of the media processing device is precluded. In addition to keeping dirt, dust, and foreign objects from entering an internal cavity of the printer and potentially contaminating the consumables or the electronics of the processing device, the closed door may also reduce noise and prevent users from inadvertently touching sensitive components.

Figure 2:
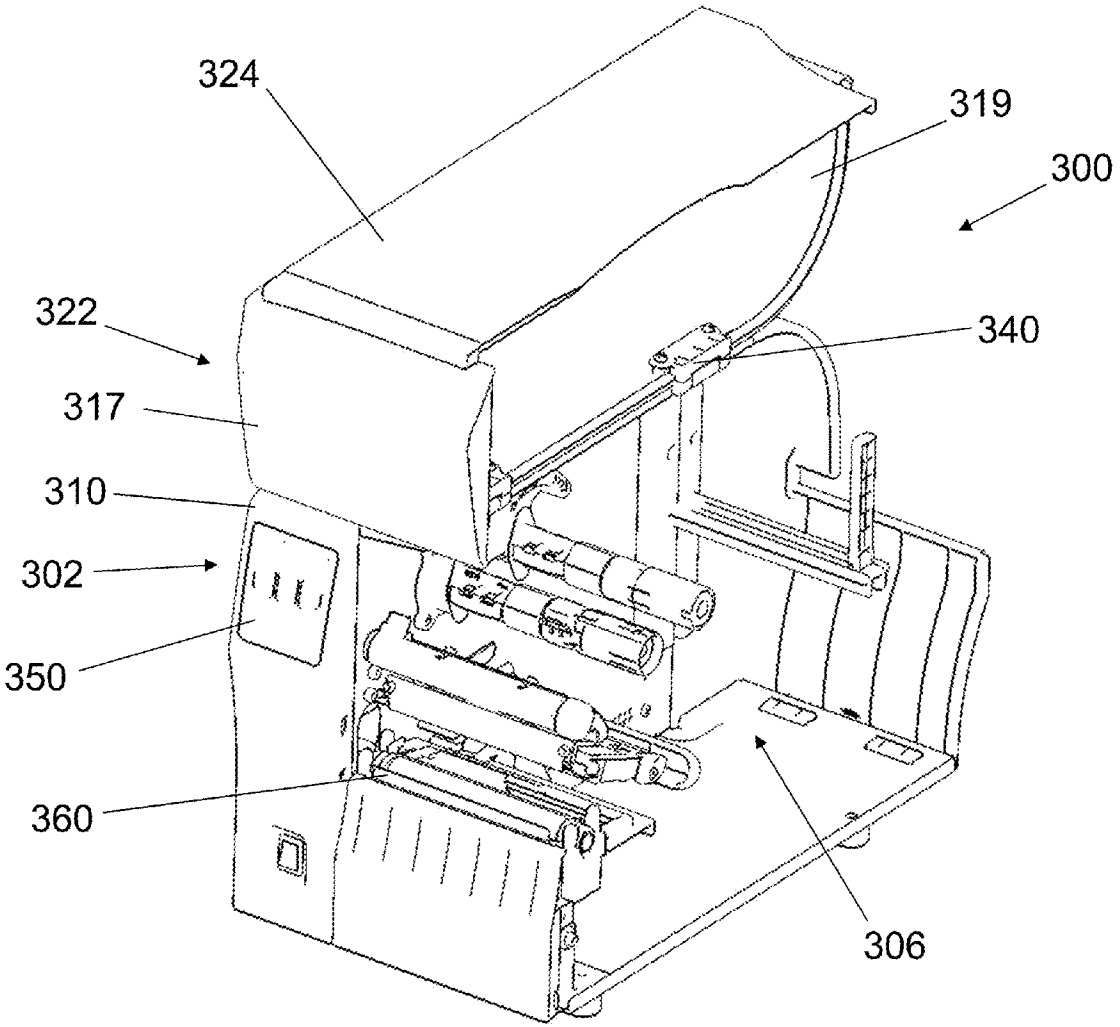
FIG. 2 illustrates a media processing device according to example embodiments of the present invention having an access door assembly disposed in a major support position.

The major door 322 of the access door assembly 320 may pivot about hinges 340 through a range of approximately 180 degrees to a major support position to provide access to an interior cavity 306 of the printer as illustrated in FIG. 2. The hinges 340 may be located proximate a centerline of the housing 301 defined between the support surface 310 and the access door assembly 320. Positioning the hinges 340 proximate a centerline of the housing 301 allows the access door assembly 320 to pivot about hinges 340 and achieve the major support position when the major door 322 comes to rest on the support surface 310. Locating the hinges 340 proximate the centerline of the housing 301 further enables the side panel 302 of the printer to be situated against a surface, such as a wall or a cabinet, while still permitting the access door assembly 320 to achieve the major support position. The major door 322 may include at least a portion of the front panel 317 and/or a portion of the rear panel 319 to provide greater access to the interior cavity 306 when the major door is disposed in the major support position as will be described further below. In other embodiments, however, the major door 322 may include only a portion of the front panel.

The minor door 324 may be hingedly attached to the major door 322 and pivotable between an operational position (as shown in FIG. 1) and a minor support position (as shown in FIG. 2). In the operational position, the minor door 324 may be substantially co-planar with the access door assembly side 304 of the housing. In this operational position, the media processing device is ready for use and the internal cavity 306 is not accessible due to the position of the access door assembly 320. Optionally, operation of the media processing device may be precluded when the access door assembly 320 is not in the operational position. As the major door 322 is rotated about hinges 340, through a range of approximately 180 degrees, the minor door 324 pivots about hinges 323 through a range of approximately 90 degrees relative to the major door 322.

Figure 4:
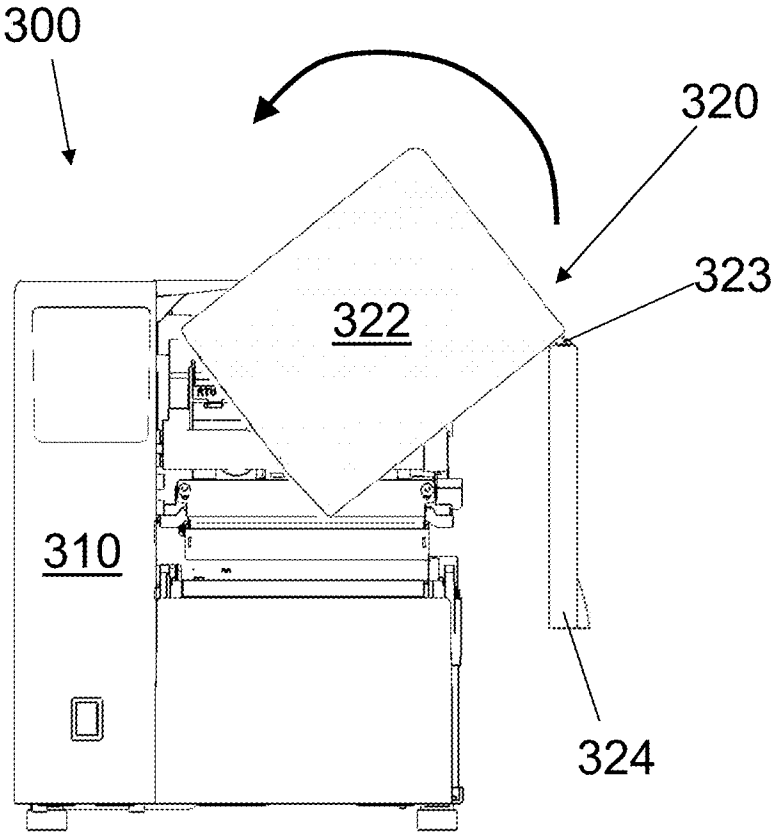
FIG. 4 depicts a front view of the media processing device shown in FIG. 2, wherein the access door assembly is disposed in transition between the operational position and the full support position.
Figure 3:
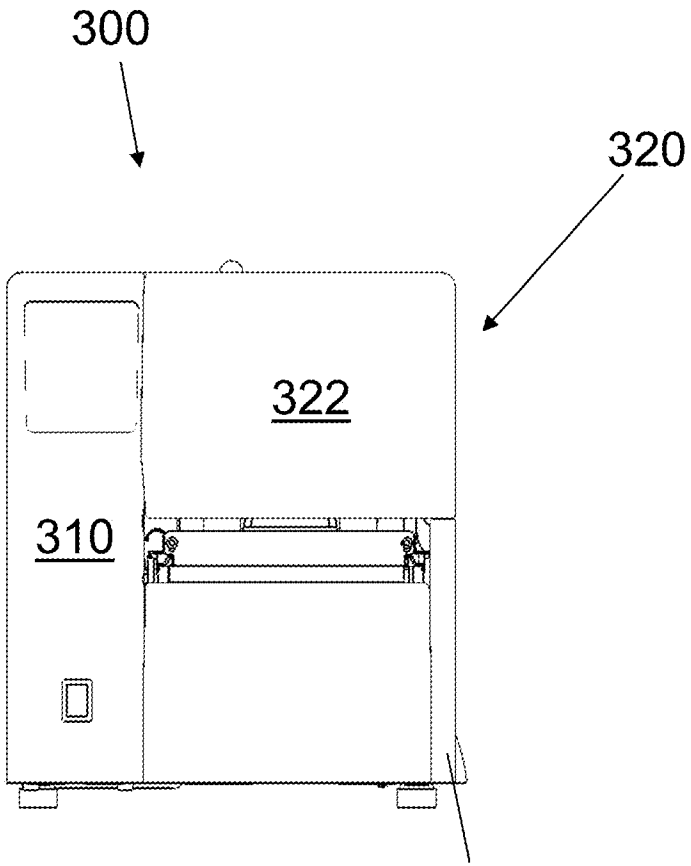
FIG. 3 depicts a front view of the media processing device shown in FIG. 2, wherein the access door assembly is disposed in an operational position.
Figure 5:
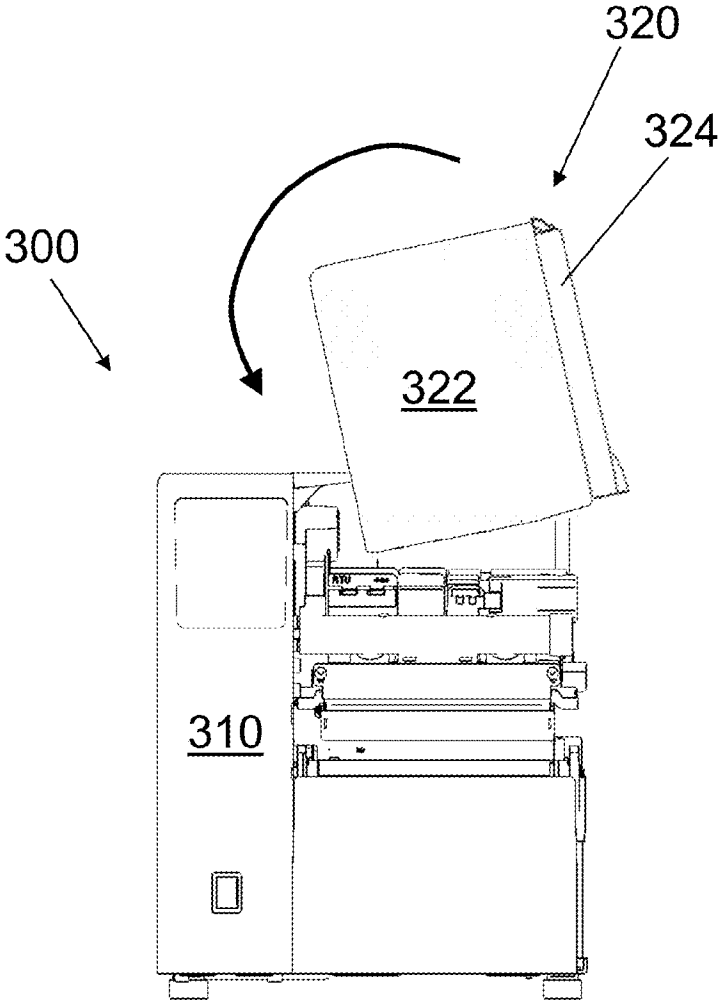
FIG. 5 depicts a front view of the media processing device shown in FIG. 2, wherein the access door assembly is comprised of a major door and a minor door, and wherein the minor door is disposed in a minor support position.

FIGS. 3-6 illustrate a frontal view of a media processing device according to example embodiments of the present invention. FIG. 3 illustrates the access door assembly 320 in an operational position where the minor door and at least a portion of the major door are generally coplanar. FIG. 4 illustrates the access door assembly 320 in transition between the operational position and the major support position. FIG. 5 illustrates the minor door 324 in the minor support position and the access door assembly 320 in transition between the operational position and the major support position. In the operational position, the back surface of the minor door faces the internal cavity 306 of the media processing device 300. When disposed in the minor support position, the back surface of the minor door 324 rests against at least a portion of the major door 322. In the illustrated embodiment, the major door includes a portion of the front surface 317 and the rear surface 319 (see FIG. 2) upon which the minor door 322 rests in the minor support position. Optionally, should the major door 322 not include portions of the front surface 317 and rear surface 319, the minor door may rest upon a stop or be supported by a maximum permitted rotation by the hinges 323 when in the minor support position.

Figure 6:
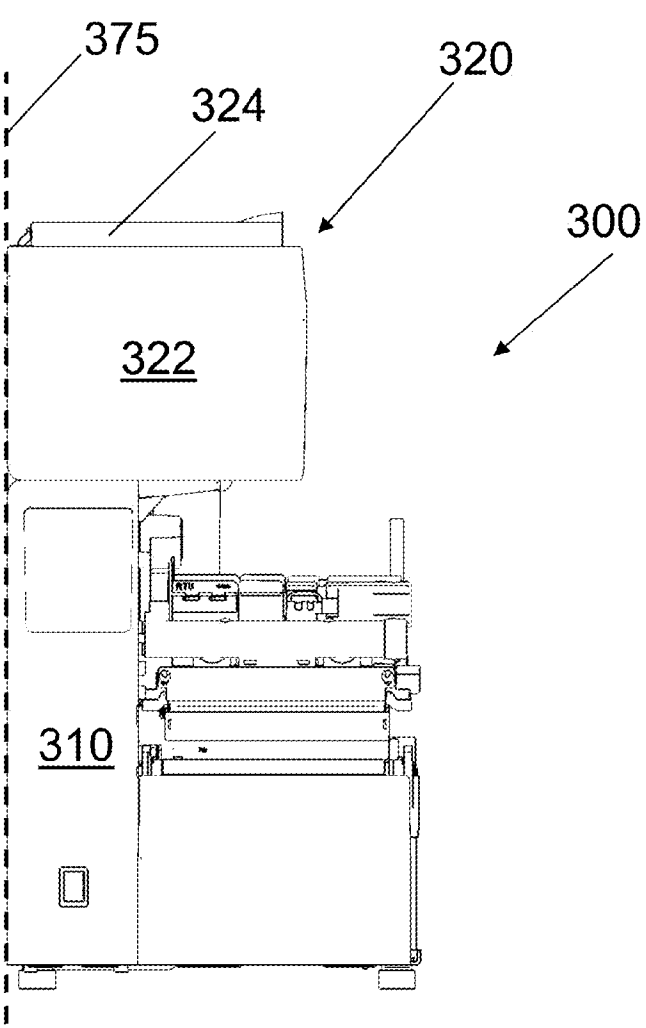
FIG. 6 depicts a front view of the media processing device shown in FIG. 2, wherein the major door is disposed in a major support position, the minor door is disposed in the minor support position, and the access door assembly is disposed in the full support position.

FIG. 6 illustrates the access door assembly 320 in the major support position and the minor door 324 in the minor support position. A portion of the major door 322 may be supported by the support surface 310 of the media processing device when the major door 322 is rotated about hinges 340 about 180 degrees. This position is called the major support position. Further illustrated in FIG. 6 is an imaginary plane 375 extending upwardly beyond the support surface 310. The access door assembly 320 may be supported on the support surface without crossing the imaginary plane 375, thereby allowing the side panel 302 of the printer 300 to be situated against a surface without hindering the opening of the access door assembly 320. A portion of the major door may be substantially coplanar with the side panel when the major door is in the major support position illustrated in FIG. 6.

Referring back to FIG. 2, when the major door 322 is in the major support position, access to all of the necessary components to load and unload consumables (e.g., print media and printer ribbon) within internal cavity 306 is provided. Access to the internal cavity 306 is provided, at least partially, through at least three sides (e.g., the front side via a portion of the front panel 317, the access door side and top side through the access door assembly 320, and/or the rear side via a portion of the rear panel 319) which permit easier access and view of the internal components as will be described below. In other embodiments, the major door 322 may include only one, or possibly neither of a portion of the front panel 317 or the rear panel 319.

Figure 7:
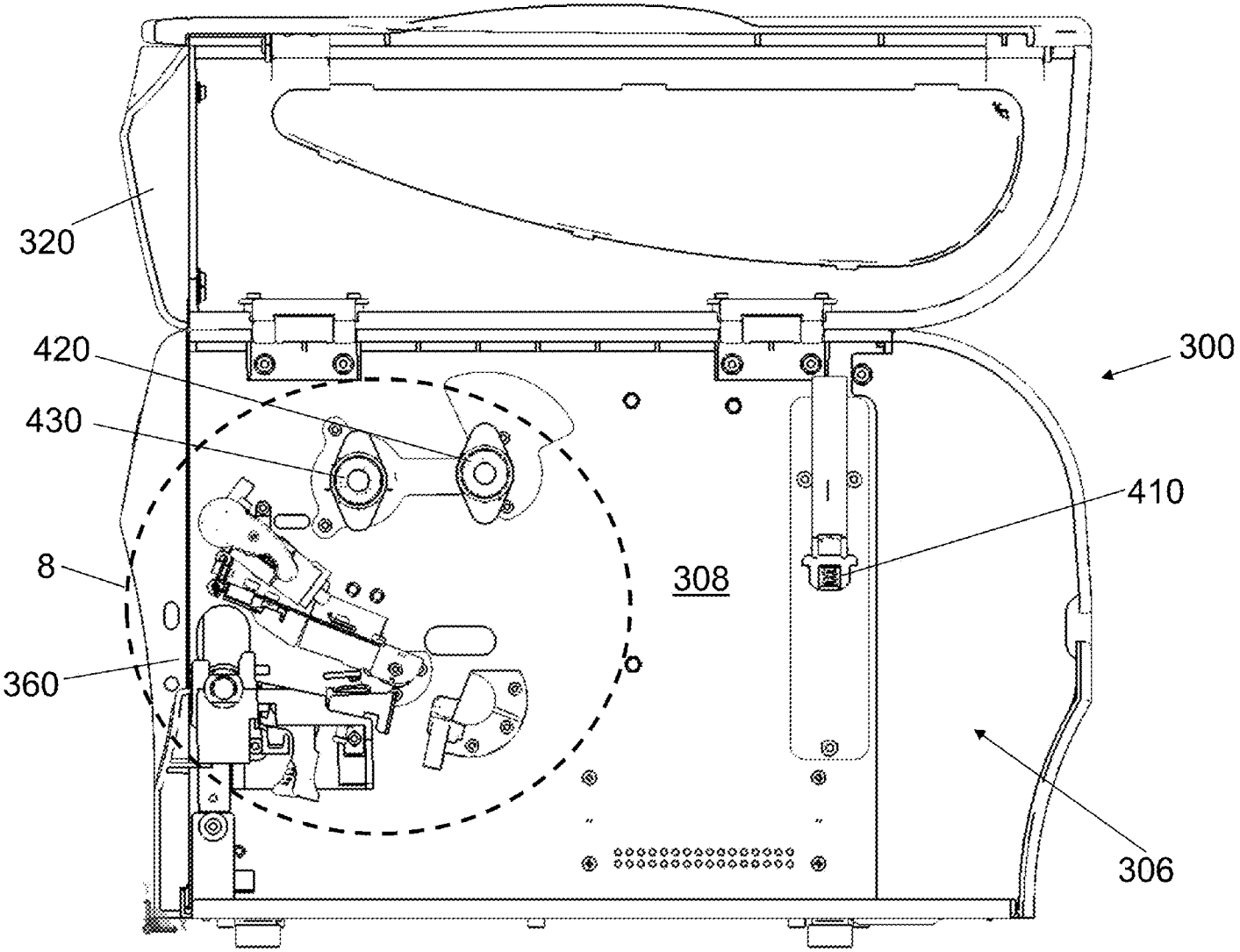
FIG. 7 illustrates a side view of a media processing device according to example embodiments of the present invention wherein the access door assembly is disposed in the full support position.

FIG. 7 illustrates a side view of a printer according to example embodiments of the present invention with the major door 322 of the access door assembly 320 in the major support position exposing the internal cavity 306 and the printer chassis 308. The printer chassis 308 is a structural member configured to support some or all of the internal components of the printer 300. The internal components within the internal cavity 306 may include a media spindle 410, a ribbon supply spindle 420, and a ribbon take up spindle 430. The media spindle 410 may be configured to hold a media spool (not shown) or media roll. The ribbon supply spindle 420 may be configured to hold a spool of the unused portion of a ribbon while the ribbon take-up spindle 430 may be configured to hold a spool of the used portion of the ribbon. Also illustrated is the media exit 360 through which printed media exits the printer 300. The printer chassis 308 holds the media spindle 410, ribbon supply and take-up spindles 420, 430, and the printing mechanisms in place within the internal cavity 306.

Figure 8:
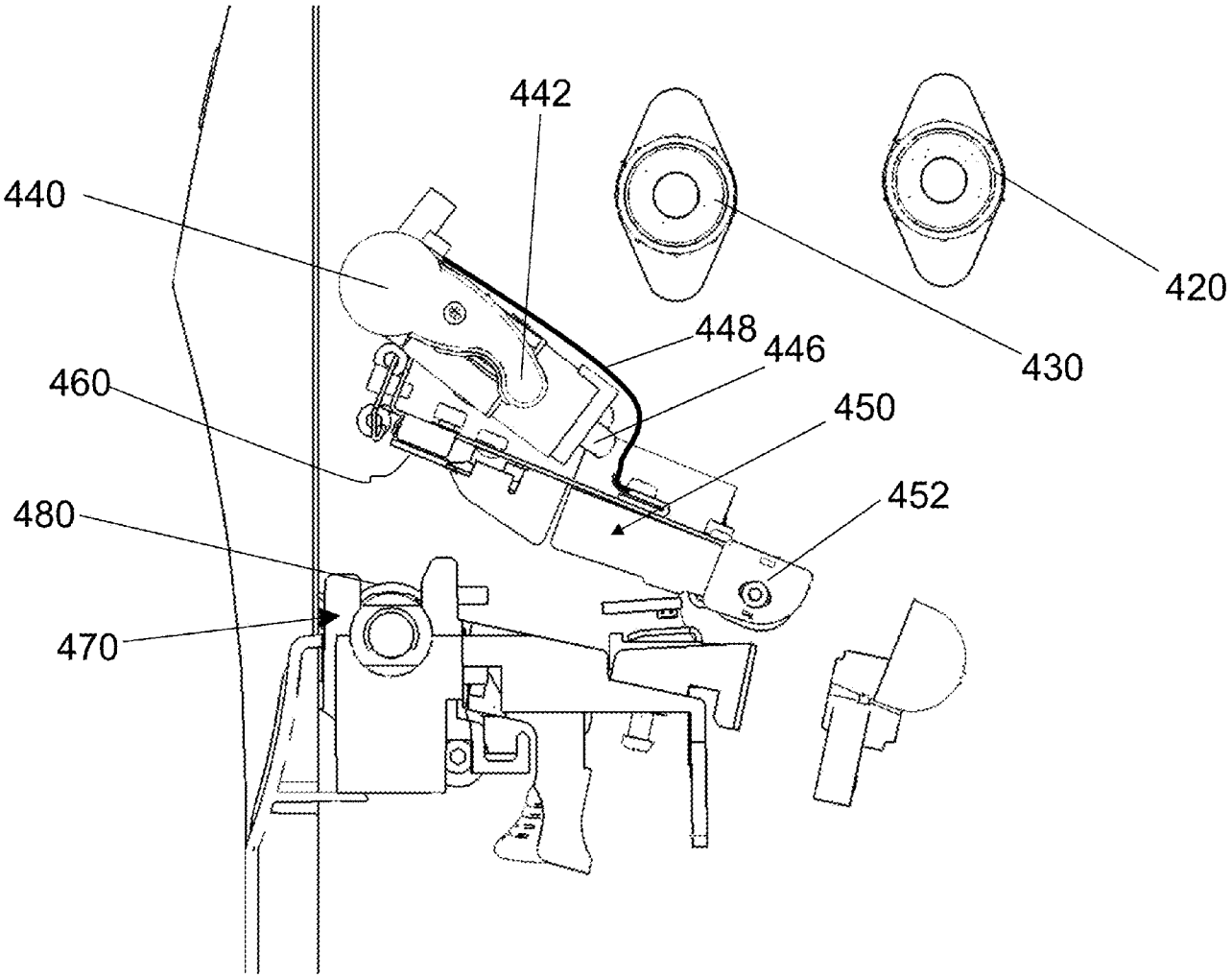
FIG. 8 illustrates a detail view of a printing mechanism of a media processing device, taken along detail circle 8 of FIG. 7.
Figure 9A:
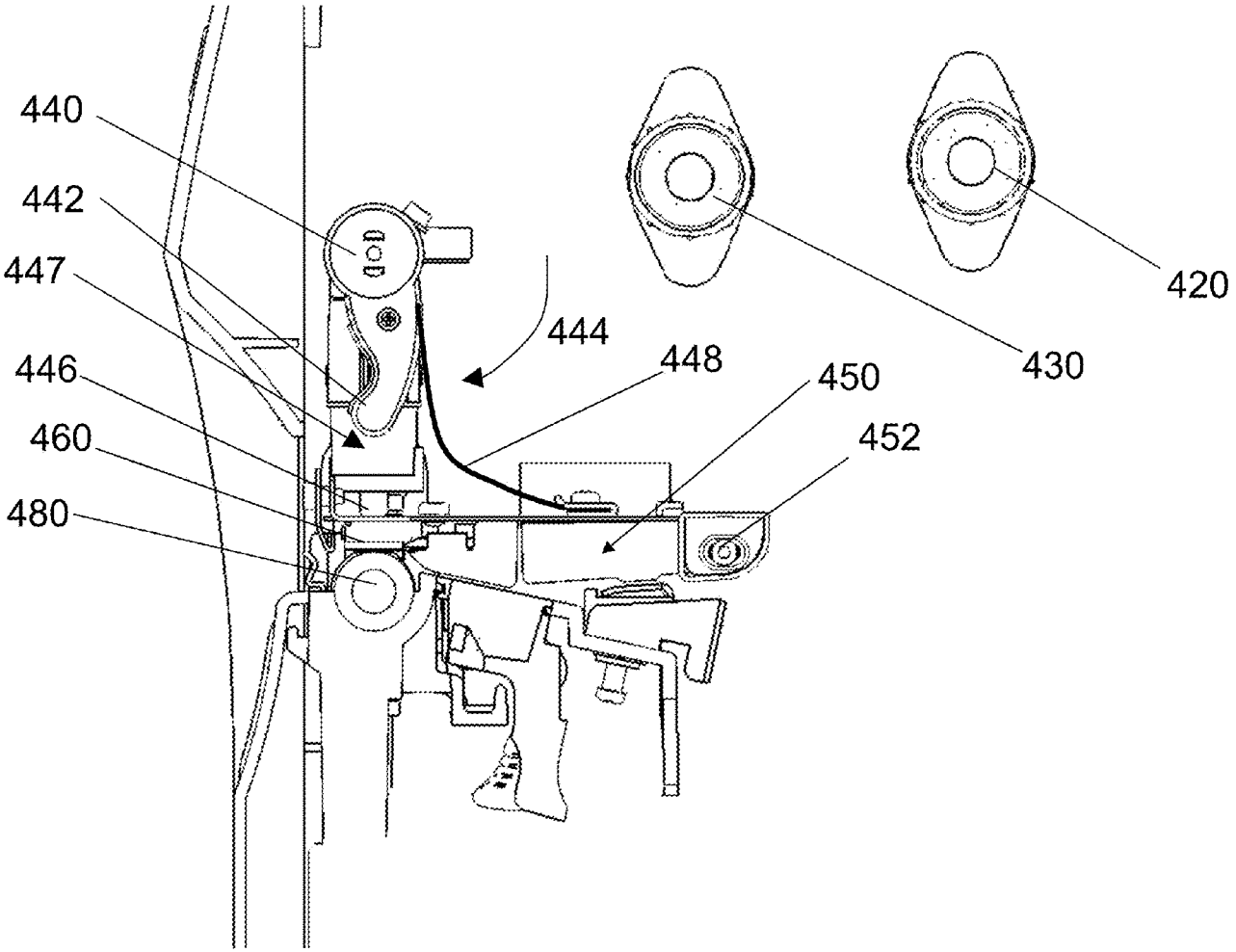
FIG. 9A illustrates a detail view of the printing mechanism of FIG. 8, wherein the printing mechanism is disposed in a printing position.

The printer chassis 308 may further hold a printing mechanism as shown in detail circle 8 which is further illustrated in FIGS. 8 and 9A depicting an enlarged view of the detail circle 8 of FIG. 7. The printing mechanism may include a printhead assembly 450 including a printhead 460, a platen assembly 470 including a platen roller 480, and a toggle assembly 440 including a toggle handle 442, biasing element 446, and a lift strap 448.

The printhead assembly 450 is illustrated in a loading position in FIG. 8 and a printing position in FIG. 9A. The illustrated printing mechanism embodiment may be configured for thermal transfer printing wherein the printhead 460 and the platen roller 480, when engaged, define a nip therebetween. A media substrate and a printer ribbon may be fed through the nip and the printhead may heat and compress the ribbon against the media substrate to deposit ink from the ribbon onto the media substrate. In the printing position, the printhead 460 engages platen roller 480 along a print line.

In the illustrated embodiment, the printhead assembly 450 of the printing mechanism is pivotally attached along axis 452 to the printer chassis 308. The printhead assembly 450 includes the printhead 460 which is mounted to the printhead assembly with a retention spring mechanism as will be further detailed below. The toggle assembly 440 is pivotally attached to the printer chassis 308 and is configured to be manually rotated by a user via handle 442 between a disengaged position (FIG. 8) and an engaged position (FIG. 9A). As the toggle assembly 440 is rotated from the disengaged position to the engaged position along arrow 444, the biasing elements 446 bias the printhead assembly 450 into the printing position. The biasing elements 446 may include a curved profile configured to slidably engage a surface of the printhead assembly 450 as the toggle assembly 440 is rotated along arrow 444. The curved profile of the biasing elements may provide a cam-type functionality which moves along the printhead assembly 450 as the toggle assembly 440 is rotated and drives the printhead assembly 450 into the printing position. Thus, the contact areas between the driving elements 446 and the printhead assembly 450 may be configured to allow a sliding motion as the toggle assembly is rotated to the engaged position. Detents within the toggle assembly 440 are configured to retain the toggle assembly in either the engaged position or the disengaged position. When the toggle assembly 440 is in the engaged position, the biasing elements 446 maintain pressure on the printhead assembly 450 in the printing position with the printhead 460 engaged with the platen roller 480. In response to the toggle assembly being moved from the engaged position of FIG. 9A to the disengaged position of FIG. 8, the biasing elements 446 are disengaged from the printhead assembly 450 and the lift strap 448 is configured to raise the printhead assembly 450 out of the printing position and into the loading position.

Figure 9B:
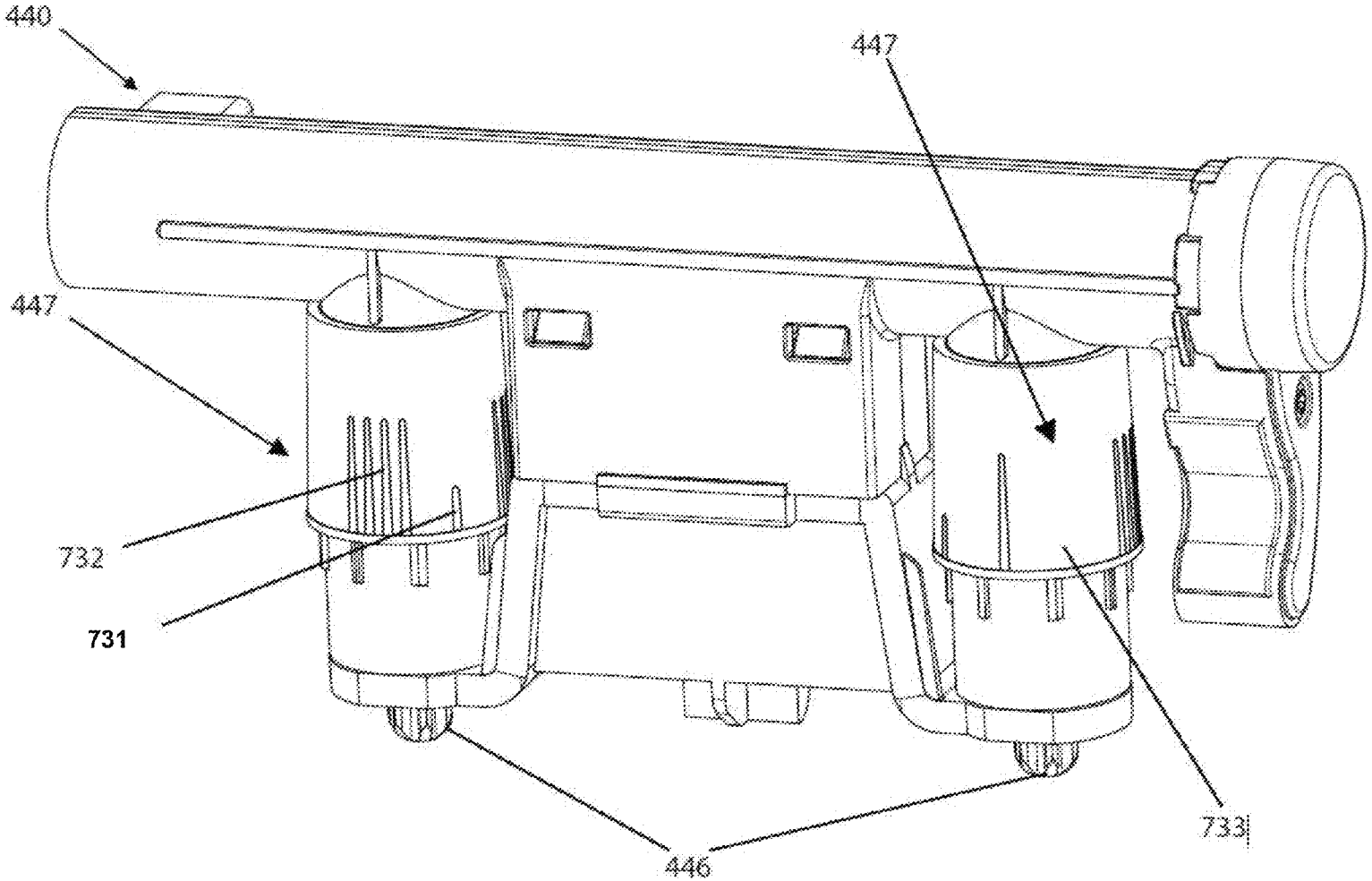
FIG. 9B illustrates a detail view of the toggle assembly of FIG. 9A.

FIG. 9B illustrates the toggle assembly 440 of the printer that is configured with two adjustment assemblies 447 adapted to support the biasing elements 446. Each adjustment assembly 447 may be configured to vary the pressure applied to the printhead assembly 450 through its corresponding biasing element 446. As the pressure between the printhead and the platen roller 480 plays a critical role in print quality, it is important to maintain a selected pressure across the printhead based upon, among other things, the media that is being printed and the printhead characteristics. Example embodiments of the present invention may be configured to apply pressure to the printhead assembly 450, where the pressure is variable between a minimum and a maximum level and where a user may adjust the pressure to numerous values within this range. For example, each biasing element may be adjustable, by the adjustment assembly to exert a force of between about 3.5 pounds-force and 9.3 pounds-force.

Figure 9C:
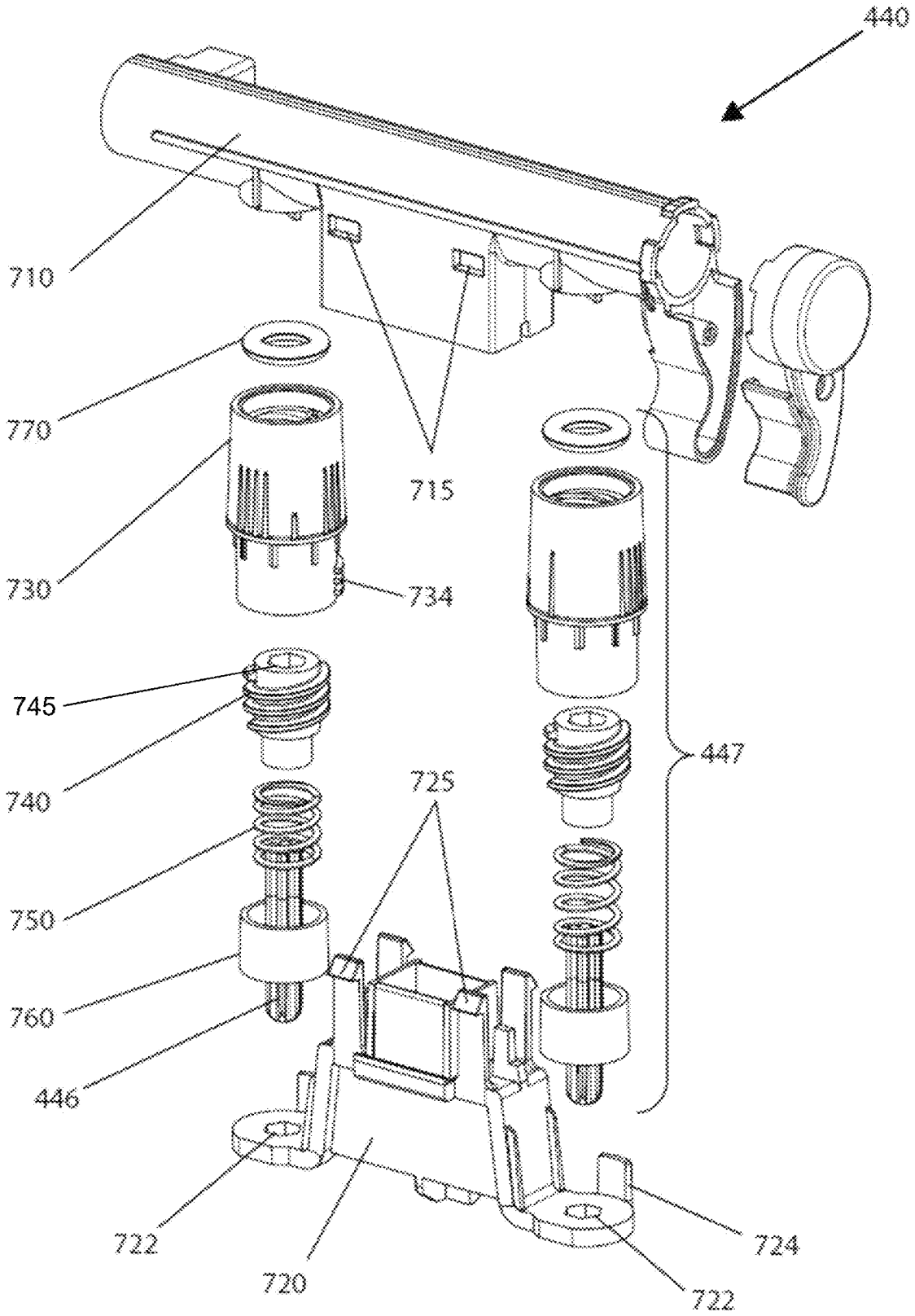
FIG. 9C illustrates an exploded view of the toggle assembly of FIG. 9B.

FIG. 9C illustrates an exploded view of the toggle assembly 440 including the two adjustment assemblies 447 and associated biasing elements 446. The toggle assembly may include a toggle bar 710 that is connected to a base plate 720. The toggle bar 710 may be connected to the base plate 720 in a variety of manners; for example, the illustrated embodiment includes interlocking tabs 725 of the base member that engage corresponding recesses 715 in the toggle bar 710.

The adjustment assemblies 447 may include a barrel 730 that is disposed between the toggle bar 710 and the base plate 720. The barrel 730 is rotatable along its longitudinal axis relative to the toggle bar 710 as will be further detailed below. Within the barrel 730 are housed a spring 750, a threaded insert 740, a cup 760, and a corresponding biasing element 446.

The biasing element 446 may define a non-circular shape, such as a hexagon, that is configured to engage a correspondingly shaped hole 722 in the base plate 720 to preclude rotation between the biasing element 446 and the base plate 720.

The cup 760 may be integrally formed with the biasing element 446 or otherwise attached to the biasing element 446 such that the cup 760 and the biasing element 446 are fixed relative to one another. In this regard, the cup 760 and the biasing element 446 may be rotationally fixed relative to the base plate 720. However, as will be further detailed below, the biasing element 446 may move axially (generally along the longitudinal axis of the barrel 730) within the hole 722 of the base plate 720.

The threaded insert 740 of the adjustment assembly 447 may define an external thread, such as a double-start ACME thread. The threaded insert 740 may be received within the barrel 730, which defines a reciprocally configured mating thread that is structured to engage the external threads of the threaded insert 740. The threaded insert 740 may further define an internal channel 745 that is configured to receive the biasing element 446 there through. The internal channel 745 of the threaded insert 740 may define a shape corresponding to the non-circular shape of the biasing element 446 to maintain the threaded insert 740 in fixed rotational alignment with the biasing element 446 (e.g., if the biasing element were hexagonal then the threaded insert 740 may define a hexagonal bore).

A spring 750 may be captured between the threaded insert 740 and the cup 760 where the biasing element 446 passes through the spring 750. When assembled, the threaded insert 740 may engage one end of the spring 750 while the other end of the spring 750 is engaged within the cup 760.

Figure 9D:
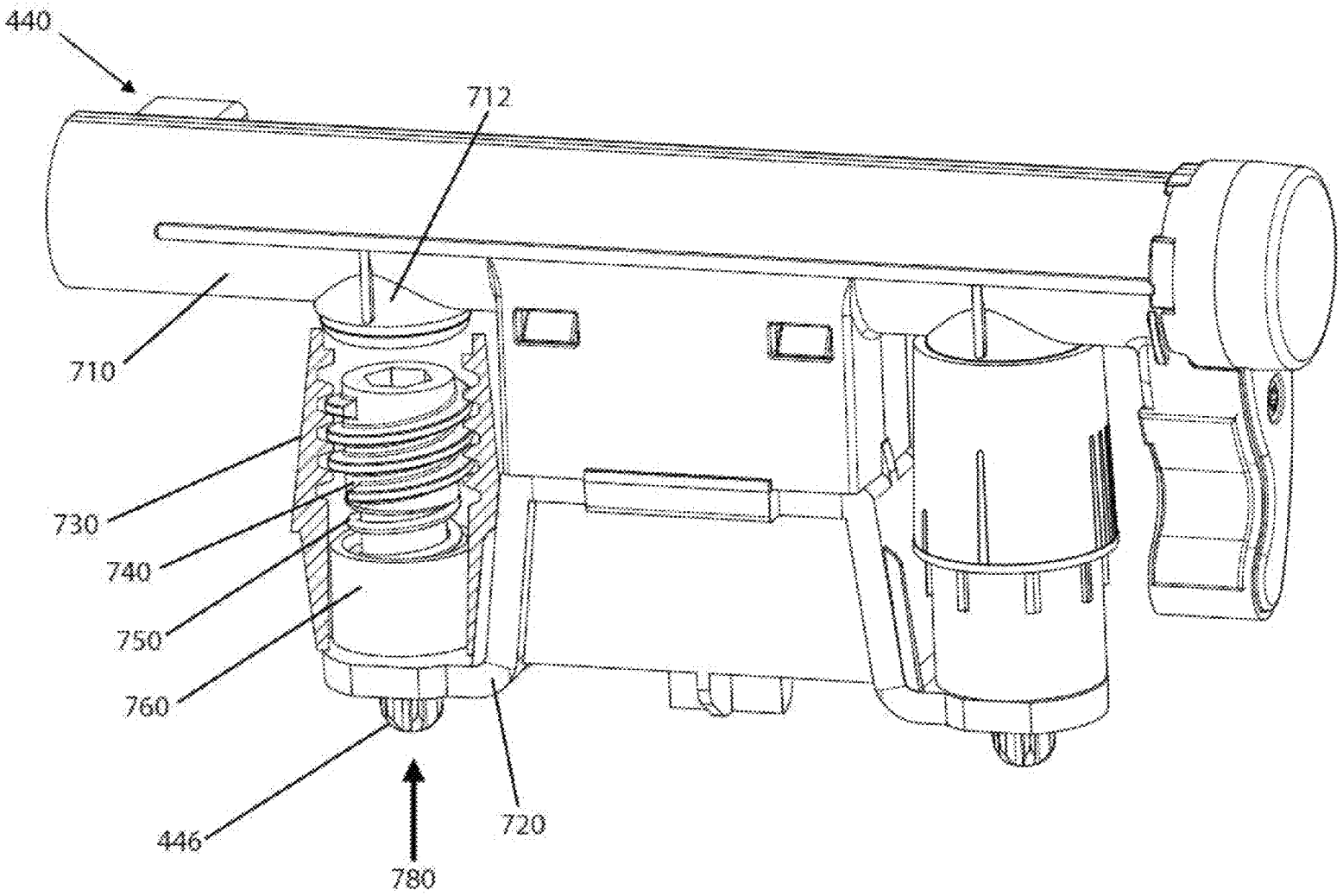
FIG. 9D illustrates a detail view of the toggle assembly of FIG. 9A including a section view of a barrel of the adjustment assembly.

FIG. 9D is a partial section view of the assembled toggle assembly 440 to better illustrate the assembled internal components of an example adjustment assembly 447. In the depicted embodiment, the external threads of the threaded insert 740 engage the internal threads of the barrel 730 and the spring 750 is held between the threaded insert 740 and the cup 760. The cup 760 is shown seated on the base member 720 with the biasing element 446 protruding through the opening in the base member 720. As cup 760 is integrally formed with the biasing element 446 or otherwise secured thereto, when the cup 760 is seated against the base member 720 as shown, the biasing element 446 extends through the hole in the base member 720 while being retained by the cup 760.

Figure 9E:
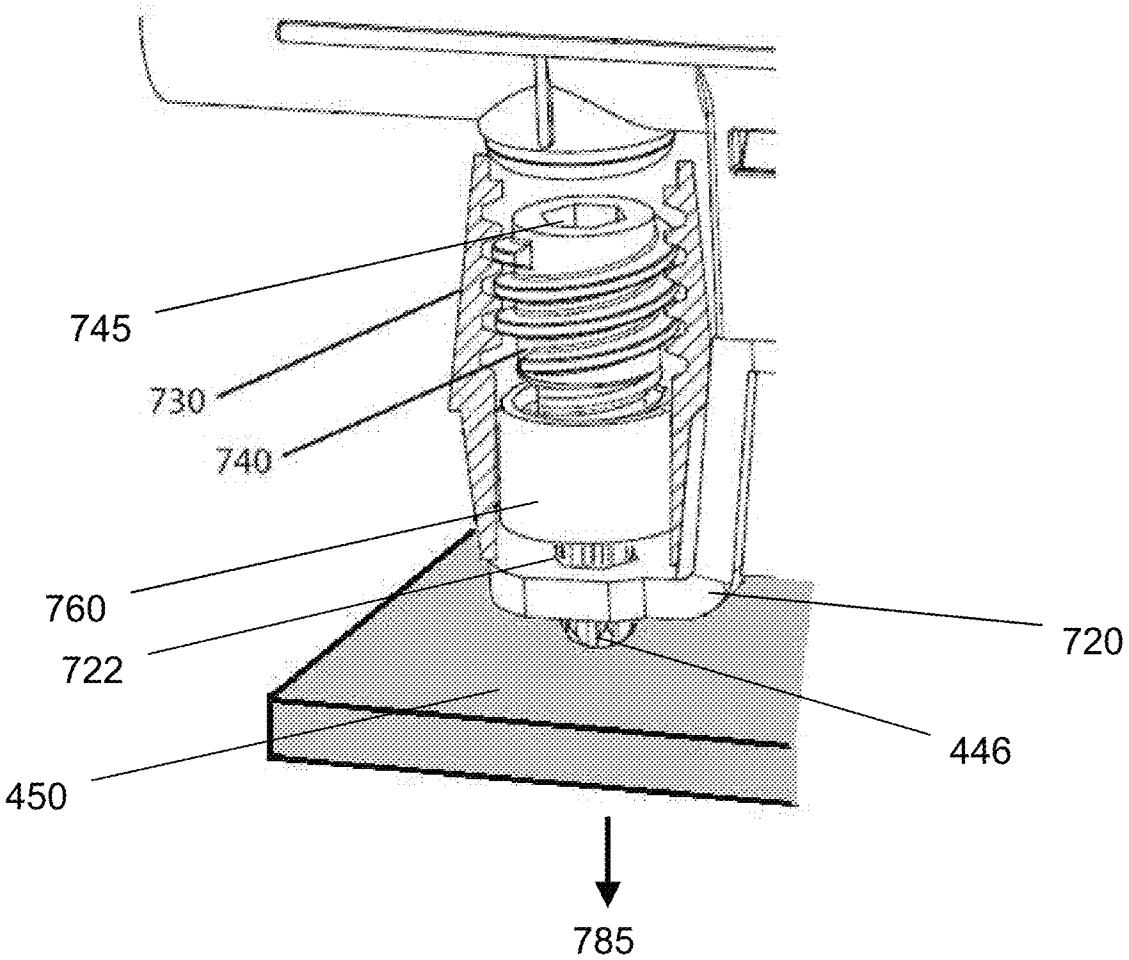
FIG. 9E is a detail view of the sectioned barrel of the adjustment assembly of FIG. 9D with the biasing element engaged with a printhead.

When the toggle assembly 440 engages the printhead assembly 450 as illustrated in FIG. 9A, the printhead assembly 450 presses against the biasing element 446 along arrow 780. As depicted in FIG. 9E, which illustrates a detail view of the sectioned adjustment assembly of FIG. 9D, the printhead assembly 450 pressing against biasing element 446 causes the cup 760 to rise off of the base member 720, thereby compressing the spring 750, such that the spring 750 applies a force to the biasing element 446, which is transmitted through the biasing element 446 to the printhead assembly 450 in the direction of arrow 785.

Figure 9F:
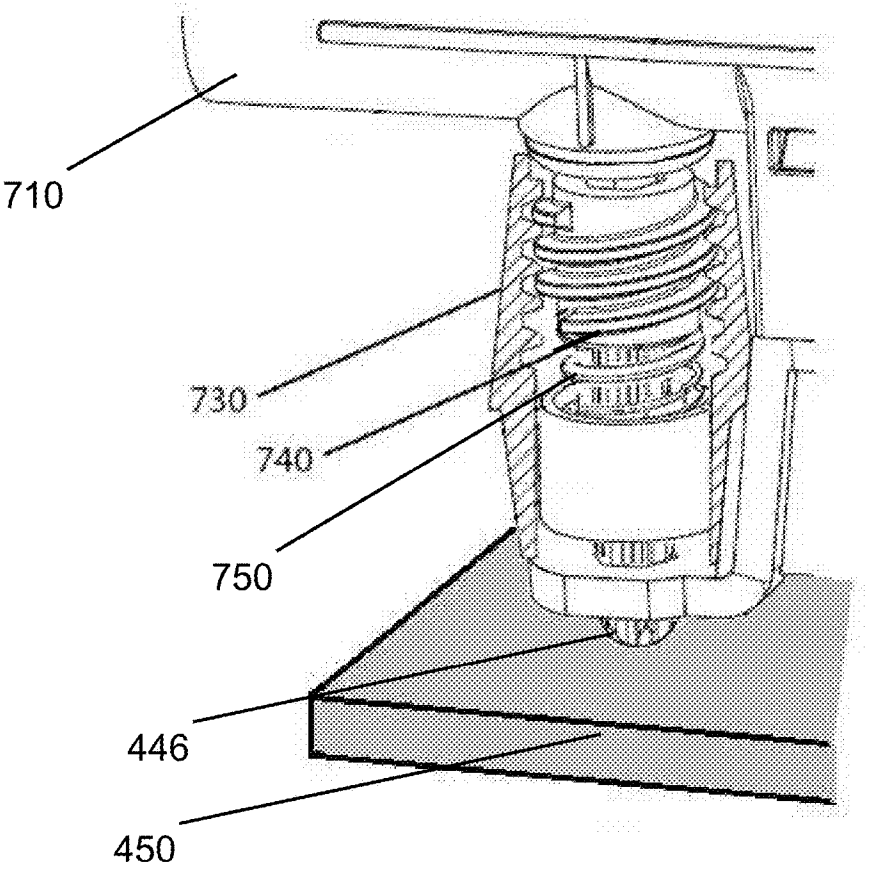
FIG. 9F is a detail view of the sectioned barrel of the adjustment assembly of FIG. 9D with the biasing element engaged with a printhead and the threaded insert in a retracted position.

The biasing force applied or transmitted by the biasing element 446 to the printhead assembly 450 may be adjusted by rotating the barrel 730 of the adjustment assembly 447. Rotation of the barrel 730 about an axis along which the biasing force is applied in a first direction (e.g., clockwise) may cause the threaded insert 740 to retract toward the toggle bar 710. As the threaded insert 740 is rotationally fixed by the biasing element 446, which his rotationally fixed by the base member 720, rotation of the barrel 730 causes the internal thread of the barrel 730 to turn relative to the threaded insert 740, which results in the threaded insert 740 advancing or retracting within the barrel 730 depending upon the direction of rotation of the barrel 730. Rotation of the barrel in a second direction (e.g., counter-clockwise) may cause the threaded insert 740 to advance toward the base member 720. FIG. 9F illustrates the sectioned adjustment assembly of FIG. 9D with the threaded insert 740 in a retracted position, toward the toggle bar 710. As depicted, the spring 750 is less compressed than the illustrated embodiment of FIG. 9E, thereby exerting a lower force on the biasing element 446 against the printhead assembly 450. The spring 750 is decompressed in response to the threaded insert 740 being retracted toward the toggle bar 710.

As will be appreciated by one of skill in the art in view of this disclosure, movement of the threaded insert 740 within the barrel 730 may compress or decompress the spring 750 between the threaded insert 740 and the cup 760. In order to increase the biasing force exerted by the biasing element 446 on the printhead assembly 450, the spring may be compressed by turning the barrel 730 in order to advance the threaded insert 740 in a direction opposite arrow 780 of FIG. 9D. In order to decrease the force exerted by the biasing element 446 on the printhead assembly 450, the spring may be decompressed by turning the barrel 730 in order to retract the threaded insert 740 in the direction of arrow 780.

In some embodiments, rotation of the barrel 730 may be limited to define a maximum biasing force and a minimum biasing force for any given spring that is used. The maximum biasing force being exerted when the spring is at a first level of compression (e.g., a relatively high level of compression) permitted by rotation of the barrel 730 and the minimum biasing force being exerted when the spring is at a second level of compression (e.g., a relatively low level of compression) permitted by rotation of the barrel. The limitation of rotation of the barrel 730 may be achieved, for example, as illustrated in FIG. 9C, by an external protrusion 734 defined by barrel 730, which is configured to engage a protrusion 724 defined by the base member 720. Such a rotation limitation feature may allow, for example, 270 degrees of rotation of the barrel. The amount of rotation, combined with the pitch of the threads (both internally on the barrel 730 and externally on the threaded insert 740), may dictate the travel of the threaded insert 740 within the barrel 730. For example, a thread pitch of six threads-per-inch, combined with a maximum rotation limit of 270 degrees may combine to allow the threaded insert to travel $1/8^{th}$ of an inch from maximum compression to maximum decompression of the spring 750.

The position of the threaded insert 740 within the barrel 730 may correlate with the biasing force applied by the spring 750; however, it is appreciated that in an example embodiment in which the cup 760 is resting on base member 720, and the spring 750 is fully decompressed, rotation of the barrel 730 to further reduce the biasing force would have no effect. Similarly, when the threaded insert 740 is rotated to the fully advanced position, further advancing of the threaded insert 740 may be precluded by the termination of the internal threads of the barrel 730, or the threaded insert 740 may be in contact with the cup 760, thereby preventing further compression of the spring 750. In such an embodiment, the biasing force may not be further increased by rotation of the barrel.

The range of force available to be exerted by the biasing element 446 on the printhead assembly 450 may also be a factor for spring 750 selection. For example, to achieve a minimum biasing force of 3.5 pounds-force and a maximum of 9.3 pounds-force, with a maximum threaded insert travel of $1/8^{th}$ of an inch, a spring 750 may be selected that is configured to provide 3.5 pounds-force at a compression of $1/16^{th}$ of an inch and provide 9.3 pounds-force at a compression of $3/16^{th}$ of an inch. As in the aforementioned example, it may be desirable to maintain a spring force on the biasing element 446 even under the minimum biasing force. Maintaining the spring in compression may be desirable such that the cup 760 is biased into engagement with the base member 720, even when the toggle mechanism 440 is moved to the disengaged position and there is no resistive force pressing against the biasing element 446. Maintaining the engagement between the cup 760 and the base member 720 applies a spring force to the threaded insert 740 thereby applying a pressure between the threads of the threaded insert 740 and the internal threads of the barrel 730 The pressure between the threads of the threaded insert 740 and the barrel 730 results in an increase in friction between the barrel 730 and the threaded insert 740 which may serve as a "barrel break" to reduce accidental or unintended rotation of the barrel 730 when the toggle assembly 440 is in the disengaged position or moved between the engaged and the disengaged positions.

The amount of force applied by the biasing elements 446 against the printhead assembly 450 may be measured, for example, as the amount of force required to initially raise the cup 760 off of the base member 720. Optionally, the printhead assembly 450 may be arranged such that when the toggle assembly 440 is in engaged with the printhead assembly 450, the biasing elements 446 are configured to be depressed within the adjustment assemblies 447 to a predefined depression. This predefined depression (e.g., $1/16^{th}$ of an inch) may be the point at which the force of the biasing elements 446 is measured.

Another mechanism by which unintended rotation of the barrel may be deterred is by increasing the friction between the barrel and the toggle bar 710. The barrel 730 may be received by a collar 712 of the toggle bar and the adjustment assembly 447 is held between the collar 712 and the base member 720. An 0-ring, such as a silicone 0-ring, may be received within a recess in the collar 712 and/or in the barrel 730. The 0-ring may provide additional friction between the collar 712 and the barrel 730 such that unintended rotation of the barrel 730 is deterred. While unintended rotation of the barrel 730 is undesirable, an unnecessarily high level of friction between the barrel and toggle bar 710 may be undesirable as a user must be able to manually turn the barrel 730 to adjust the biasing force. Therefore, the force required to turn the barrel 730 may be high enough to deter unintended rotation, but low enough to allow a user to easily rotate the barrel 730. To aid a user in rotation of the barrel, the barrel 730, or a portion thereof, may be coated with a soft-touch or higher friction material (e.g., rubber) that enables a user to more easily turn the barrel 730, possibly with the use of a single finger.

The barrel 730 may be configured with demarcations 732, 733 around the exterior of the barrel, as shown in FIG. 9B. The demarcations may be indicative of the biasing force level of the adjustment assembly 447. A stationary mark may be located on the toggle bar 710 or the base member 720 such that alignment between the stationary mark and the demarcations 732, 733 may indicate the biasing force level. Optionally, the demarcations may be arranged to face a particularly visible direction as an indication of the biasing force level. A single bar, as illustrated at 733, may be indicative of the lowest biasing force level (i.e., the threaded insert 740 is fully retracted within the barrel, towards the toggle bar 710), while four bars, as illustrated at 732, may be indicative of the highest force level (i.e., the threaded insert 740 is fully advanced within the barrel, away from toggle bar 710). While the illustrated demarcations are a series of lines, any series of demarcations may be used that convey an increasing level of biasing force. Smaller demarcations 731 may also be provided between the larger demarcations 732, 733 to provide reference marks for users to reference during adjustment.

As printhead and material characteristics may be variable, the biasing force of each of the adjustment assemblies 447 may be independently adjusted, and the appropriate biasing force for optimum print quality may be different between the adjustment assemblies.

As previously outlined, the toggle assembly 440 may be configured to lift the printhead assembly 450 from the printing position to the loading position. The lift strap 448 may be attached at one end to the toggle assembly 440 and at the other end to the printhead assembly 450. The lift strap 448 may be made of any flexible, high-tensile strength material with low elasticity, but is preferably a polyester film. In response to the toggle assembly 440 being moved from the engaged position of FIG. 9A to the disengaged position of FIG. 8, the toggle assembly 440 lifts the lift strap 448 to raise the printhead assembly 450 from the printing position to the loading position. Further, the lift strap 448 suspends the printhead assembly 450 in the loading position while the toggle assembly 440 is in the disengaged position.

Figure 10:
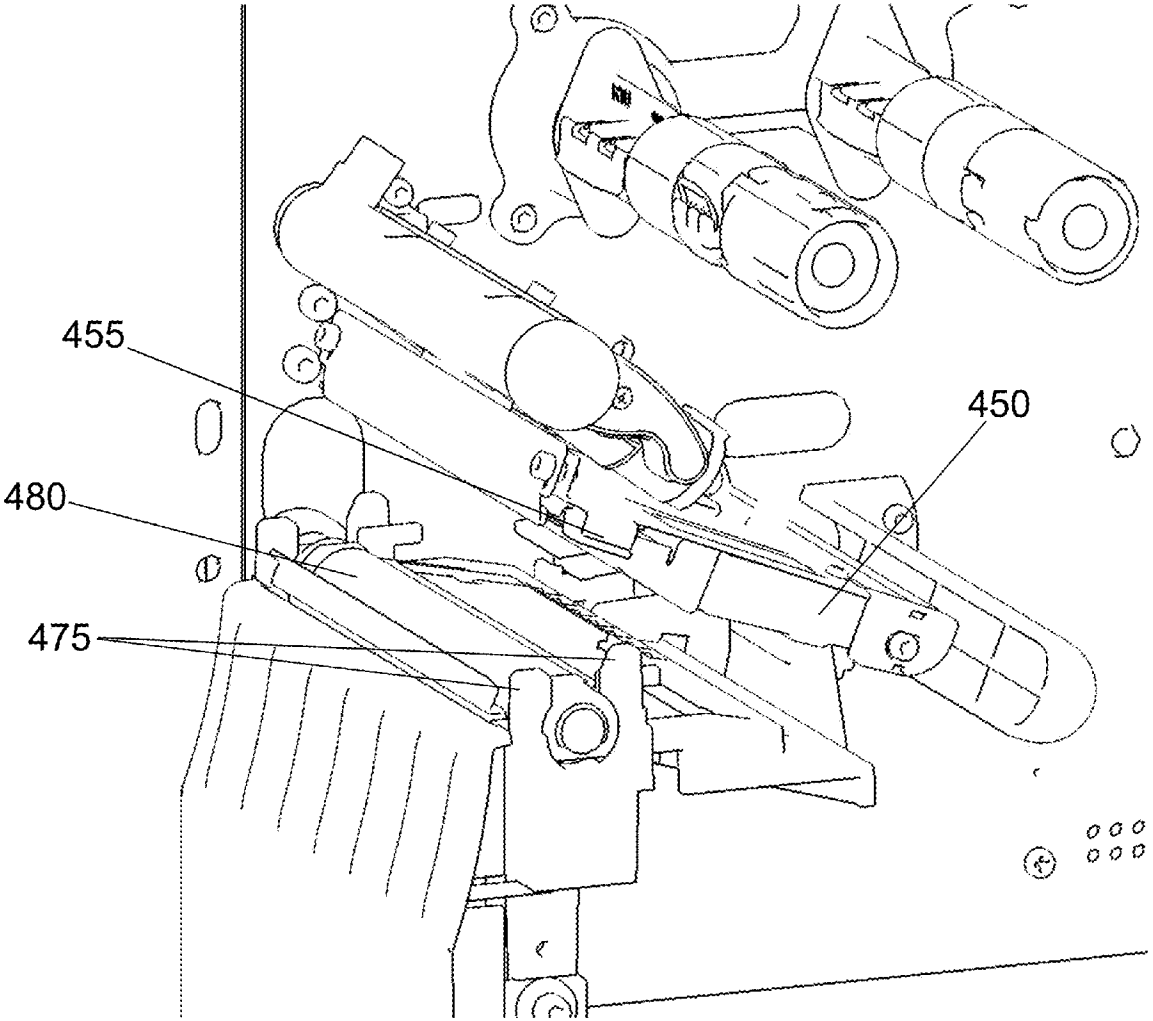
FIG. 10 illustrates a perspective detail view of the printing mechanism of FIG. 8, wherein the printing mechanism is disposed in the loading position.
Figure 11:
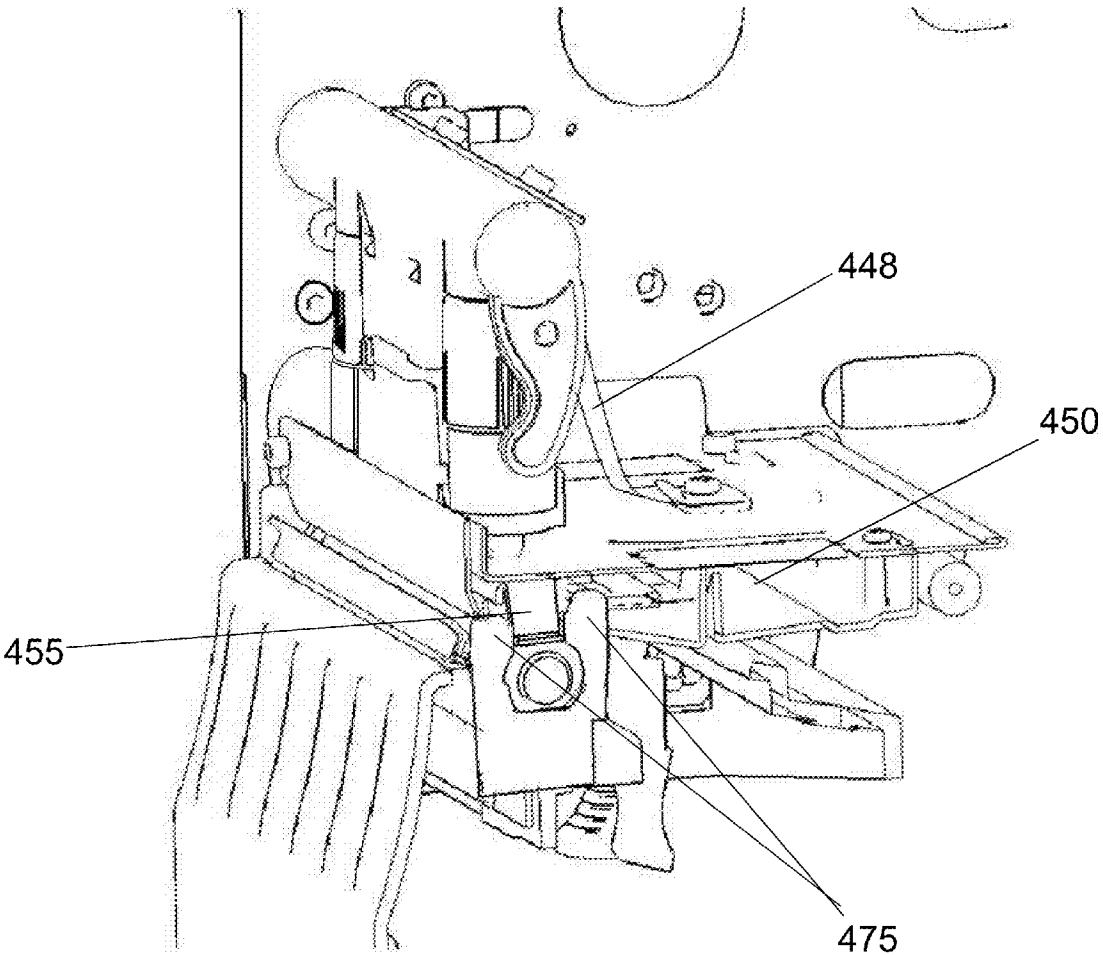
FIG. 11 illustrates a perspective detail view of the printing mechanism of FIG. 8, wherein the printing mechanism is disposed in the printing position.

FIGS. 10 and 11 illustrate perspective views of the print mechanism in the loading position and the printing position respectively. As illustrated, in the loading position of FIG. 10, the printhead assembly 450 is raised away from the platen roller 480 and platen assembly. The platen assembly includes forks 475 projecting upwardly from the platen assembly and configured to engage the printhead assembly 450. The forks 475 are configured with a bevel disposed on their inward-facing sides arranged to receive a corresponding tab 455 from the printhead assembly 450. The tab 455 engages the forks 475 to align the printhead 460 with the platen roller 480. The forks 475 align the printhead 460 to the platen roller 480 to achieve the optimum print-line location between the components. Proper alignment results in higher quality printing. As the printhead assembly 450 is moved from the loading position to the printing position, the forks 475 engage the tabs 455 of the printhead 460 to adjust the location of the printhead 460 relative to the platen roller 480 to achieve proper alignment.

Figure 12A:
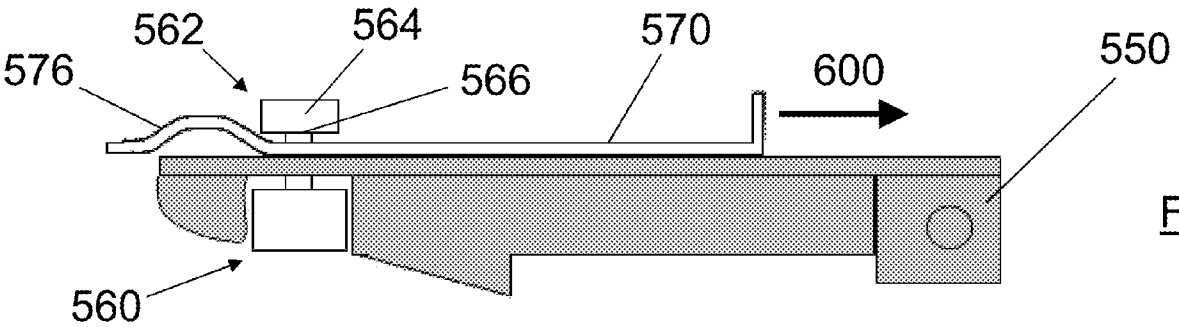
FIG. 12A is a side view of a printhead assembly for a media processing device according to example embodiments of the present invention with a retention spring in a disengaged position.
Figure 12B:
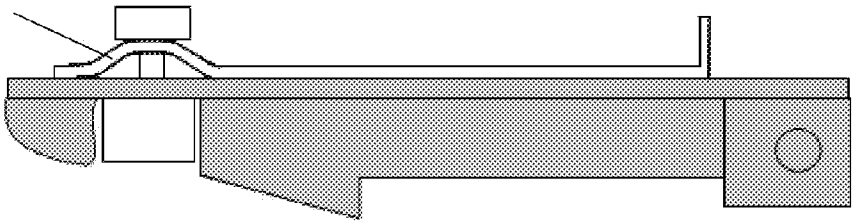
FIG. 12B is a side view of the printhead assembly of FIG. 12A, wherein the retention spring in an engaged position.
Figure 12C:
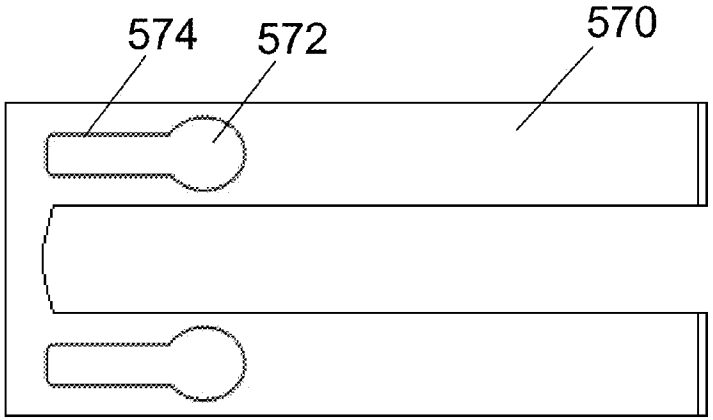
FIG. 12C is a top view of a retention spring structured according to example embodiments of the present invention.

Example embodiments of the present invention may provide a quick-release printhead attachment mechanism whereby the printhead 560 is secured to the printhead assembly 550. FIG. 12A depicts a printhead assembly 550 including a printhead 560. The printhead 560 may include one or more studs 562 extending from the back of the printhead 560. The studs 562 include a relatively large diameter head 564 with a relatively small diameter stem 566. The printhead 560 is configured to be securely attached to the printhead assembly 550 by inserting the studs 562 through a respective through hole in the printhead assembly 550 and through a respective keyhole 572 in a retention spring 570 when the retention spring is in the unlocked position depicted in FIG. 12A. An example embodiment of the top view of a retention spring is illustrated in FIG. 12C including the keyhole 572 with a keyway 574. Once the studs 562 of the printhead 560 are inserted through the printhead assembly 550 and the keyhole 572 of the retention spring 570, the retention spring 570 may be slid in the direction of arrow 600 to a locked position as illustrated in FIG. 12B.

In response to the retention spring 570 being slid in the direction of arrow 600, the stud 562 slides from keyhole 572 to keyway 574. The head 564 of the stud 562 is configured to be a greater diameter than the width of the keyway 574 such that the stud cannot be removed from the printhead assembly 550 as the stud head 564 will not pass through the keyway 574 of the retention spring 570. As the retention spring 570 is moved in the direction of arrow 600, the head 564 of the stud 562 is engaged by an arcuate portion 576 of the retention spring 570. The arcuate portion 576 drives the head 564 of the stud 562 in an upward direction relative to the printhead assembly 550, thereby drawing the printhead 560 into a secured position on the printhead assembly 550. The retention spring 570 maintains the printhead 560 in the secured position as the arcuate portion 576 in its relaxed state is of greater height than the height of the stud head 564 in the secured position. The resultant deformation of the arcuate portion 576 maintains tension on the stud 562, thereby holding the printhead 560 securely in position on the printhead assembly 550.

Removal of the printhead 560 from the printhead assembly 550 may be performed by sliding the retention spring 570 in a direction opposite arrow 600, disengaging the arcuate portion 576 from the stud 562 and allowing the stud head 564 to pass through the keyhole 572 and the through-hole through the printhead assembly 550.

Figure 13:
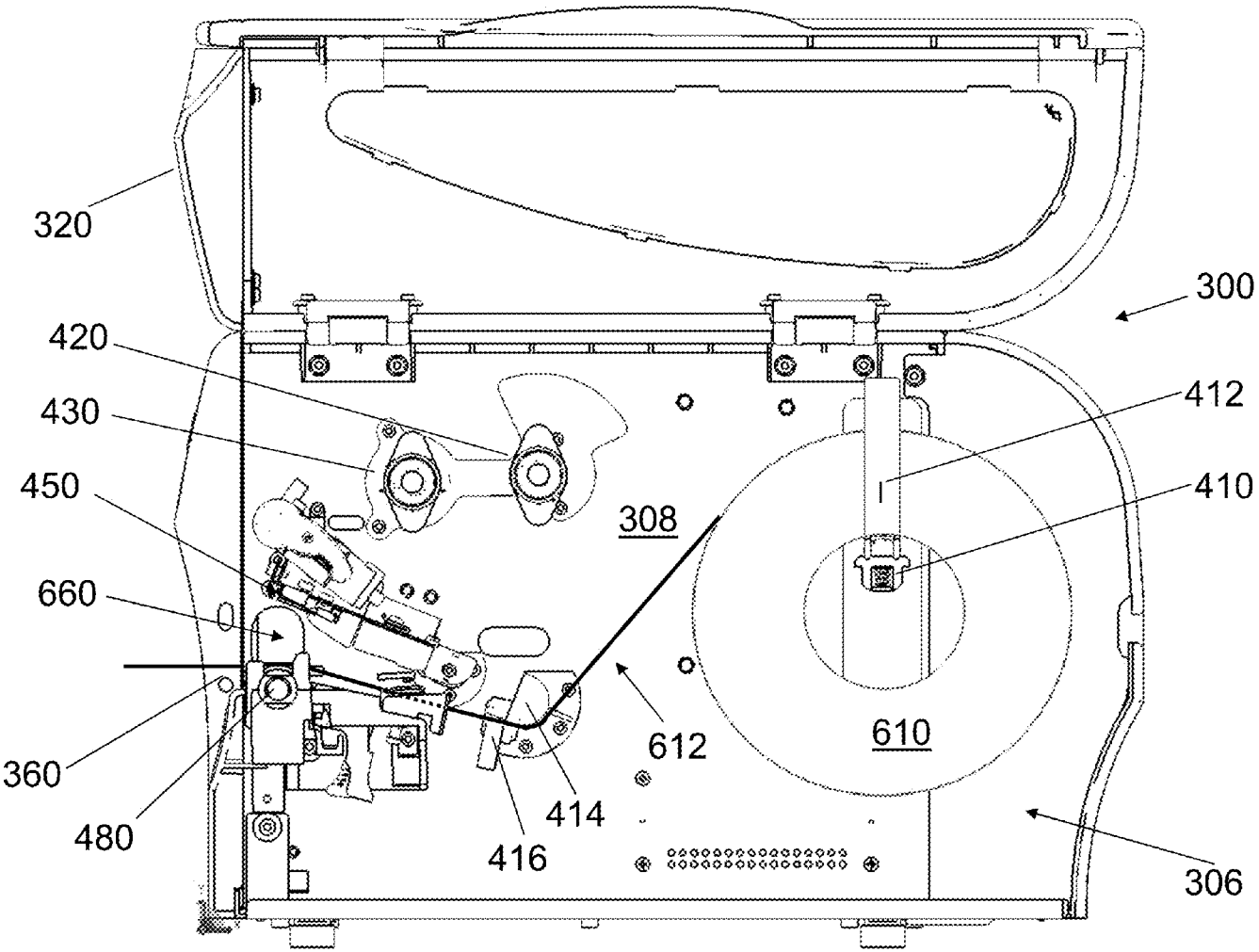
FIG. 13 is a side view of the media processing device of FIG. 7 with a roll of media installed.

Before a printing operation may begin, the print media must be loaded into the printer. FIG. 13 illustrates the printer of FIG. 7 with a media roll 610 loaded on the media spindle 410. The illustrated embodiment includes a media spindle alignment feature 412, a media guide 414, and a media sensor 416. The alignment feature 412 that may fold or rotate to a loading position, whereby a media roll 610 may be loaded onto the media spindle 410, and subsequently, the alignment feature 412 may fold or rotate back into engagement with the media roll 610 to maintain the media roll 610 in the proper position on the media spindle 410. The media web 612 may extend from the media roll, through one or more guiding features, to the printing mechanism and/or other processing components. In the illustrated embodiment, the media web 612 extends from the media roll 610, around the media guide 414 and past the media sensor 416 to arrive at the printhead assembly 450.

The media sensor 416 may provide a signal to the printer electronics when the media web is present which may allow the printer to determine when printing may occur. The media sensor may be configured to read or otherwise sense the transition or delineation between individual media elements on the media web 612 to enable alignment of the image printed at the print line of the printhead 460 relative to the edges of the media element. The media web 612 may extend along the printhead assembly 450, between the nip defined by the printhead 460 and the platen roller 480, and out through the media exit 360. As illustrated, when the printhead assembly 450 is disengaged from the platen roller 480, a loading gap 660 is created between the printhead 460 and the platen roller 480 which allows a user to more easily feed the media web 612 from the media roll 610, past the media sensor 416, and through the print mechanism to the media exit 360. Conventionally, if the printhead 460 does not disengage from the platen roller 480, the structure of the platen/printhead nip can present a conflict in that tight tolerances between the printhead 460 and the platen 480 assist in printing, but such tolerances may make it difficult for a user to insert the print media web 612 between the printhead 460 and the platen 480 during loading of the print media web 612 into the printer 300.

Figure 14:
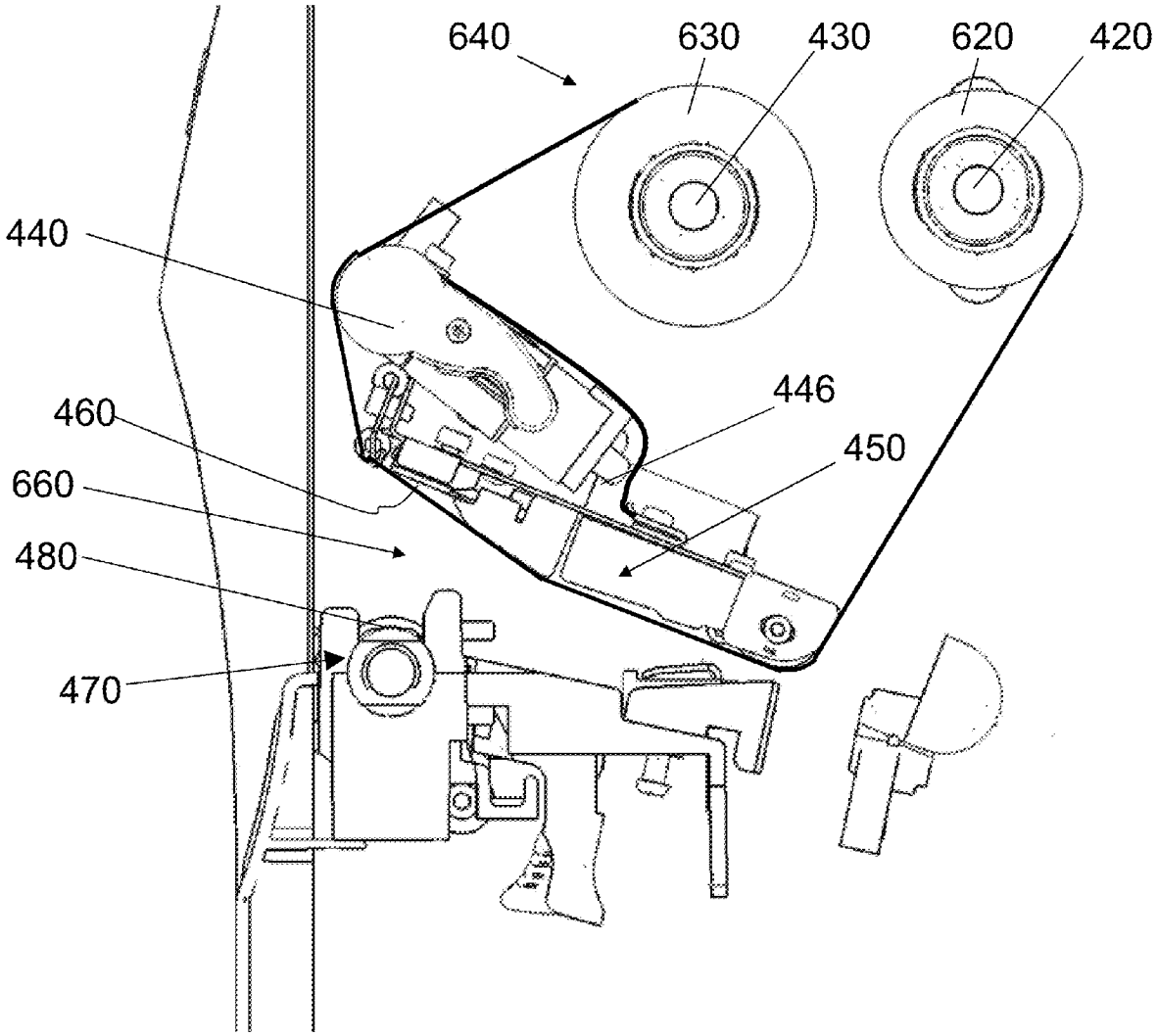
FIG. 14 is a detail view of the printing mechanism of FIG. 8, wherein the printing mechanism is disposed in the loading position and ribbon has been installed.

Example embodiments of the present invention may allow simplified media loading as described above; however, example embodiments may further provide for simplified ribbon loading as described herein. Thermal transfer printers use an ink ribbon that contains ink disposed on a substrate, where the ink is transferred to a media substrate via pressure and heat. Media processing devices according to example embodiments of the present invention may use any number of types of ribbons including dye ribbons, hologram ribbons, security material ribbons, and UV coating ribbons, among others. Therefore, in addition to the media substrate being loaded and aligned between the printhead assembly 450 and the platen roller 480, the ink ribbon 640 must be similarly inserted between the printhead 460 and the platen roller 480. FIG. 14 illustrates the printing mechanism of FIG. 8 with a printer ribbon installed. The ink ribbon 640 includes a supply spool 620 and a take-up spool 630, each disposed on a respective spindle. The ink ribbon 640 is fed along an ink ribbon path extending from the supply spool 620, around the printhead assembly 450, past the printhead 460. The ink ribbon 640 makes a relatively sharp upward transition after the printhead 460 toward the toggle assembly 440, around which the ink ribbon bends to arrive at the take-up spool 630. The relatively sharp transition after the printhead 460 provides a peel-mechanism whereby the ink ribbon is lifted from the media substrate at a sharp angle to reduce the flash or excess ink that may surround a printed image.

Figure 15:
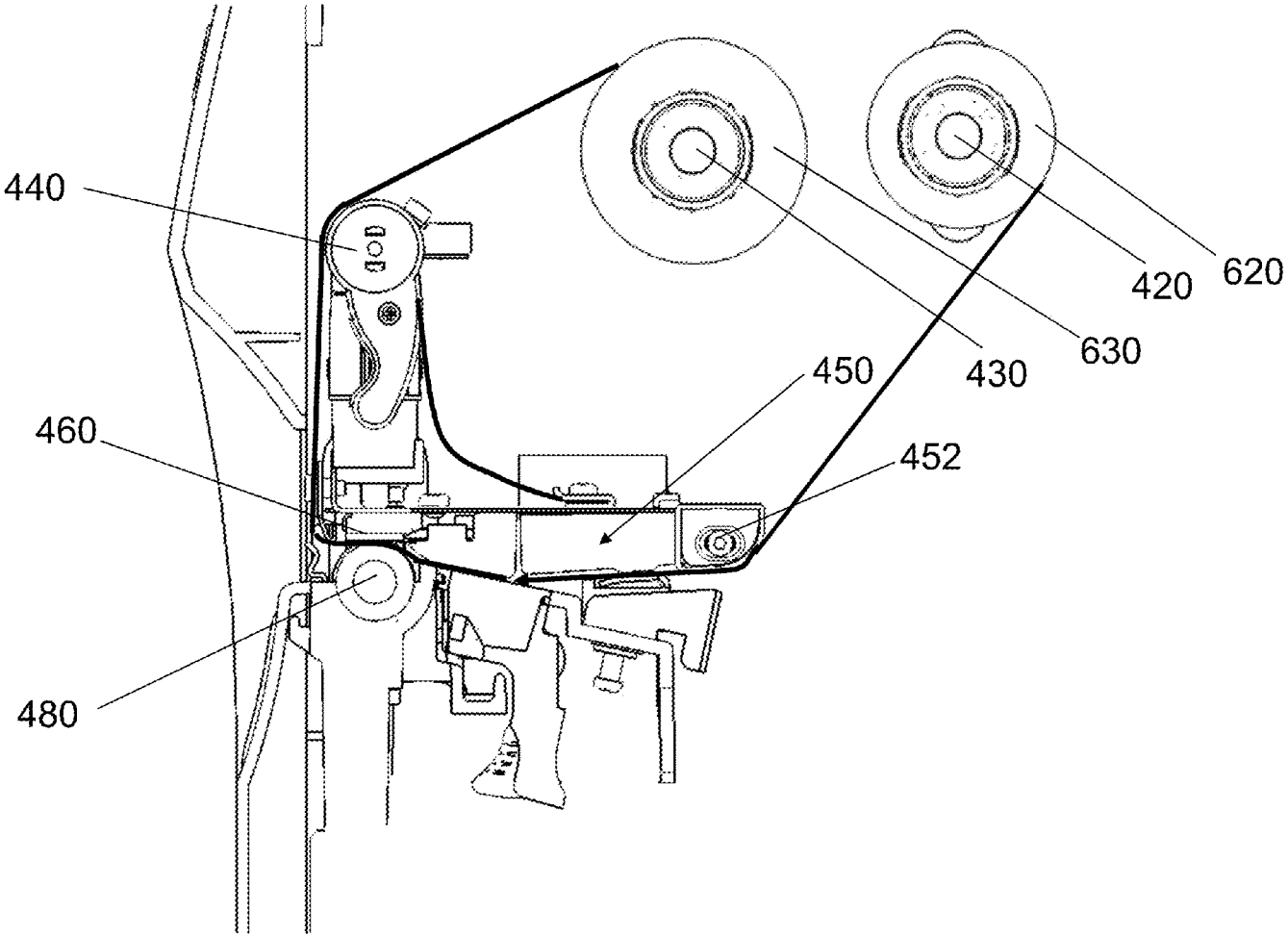
FIG. 15 is a detail view of the printing mechanism of FIG. 14, wherein the printing mechanism is disposed in the printing position.

FIG. 14 illustrates the ink ribbon 640 installed onto the print mechanism and properly routed past the printhead 460. As illustrated, the loading gap created 660 when the printhead assembly 450 is disengaged from the platen roller 480 allows the ribbon 640 to be easily routed and aligned to the printhead assembly 450. FIG. 15 illustrates the ink ribbon 640 as installed with the printhead assembly 450 in the engaged position. As depicted, the path from the supply spool 620 to the take up spool 630 is longer when the printhead assembly 450 is in the printing position such that when the toggle assembly 440 is moved from the loading position to the printing position, tension is applied to the ink ribbon 640. The tension applied to the ink ribbon 640 is desirable and ensures that the ink ribbon 640 lays flat against the printhead 460. Further, the tension applied to the ink ribbon 640 provides more consistent and repeatable alignment of the ribbon.

As will be apparent to one of ordinary skill in the art in view of this disclosure, print media and ink ribbon may be loaded and fed with greater ease and flexibility by incorporating one or more structures herein discussed.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A printhead pressure adjustment assembly comprising:
- a barrel configured to rotate about an axis;
- a biasing element received within the barrel and configured to apply a biasing force generally along the axis to a printhead; and
- a threaded insert received within the barrel, the threaded insert comprising external threads configured to engage reciprocally configured internal threads defined by the barrel to translate the threaded insert generally along the axis within the barrel in response to the barrel being rotated;
- wherein the biasing force applied to the printhead is adjustable in response to the barrel being rotated.

2. The printhead pressure adjustment assembly of claim 1, wherein the biasing force is configured to be adjustable between about 3.5 pounds-force and about 9.3 pounds-force.

3. The printhead pressure adjustment assembly of claim 1, further comprising a spring disposed within the barrel and configured to apply the biasing force to the biasing element.

4. The printhead pressure adjustment assembly of claim 1, wherein the barrel comprises biasing force level demarcations arranged around a perimeter of the barrel for reference by a user during biasing force adjustment.

5. The printhead pressure adjustment assembly of claim 1, further comprising a cup received within the barrel and attached to the biasing element.

6. The printhead pressure adjustment assembly of claim 5, further comprising a spring disposed between the threaded insert and the cup, wherein the spring is compressed in response to the barrel being rotated in a first direction and the spring is decompressed in response to the barrel being rotated in a second direction, opposite the first direction.

7. The printhead pressure adjustment assembly of claim 1, further comprising a spring configured to be compressed between the biasing element and the threaded insert, wherein the spring applies the biasing force to the biasing element, wherein the spring is compressed in response to the barrel being rotated in a first direction and the spring is decompressed in response to the barrel being rotated in a second direction, opposite the first direction.

8. The printhead pressure adjustment assembly of claim 7, wherein the biasing force is increased in response to the spring being compressed and wherein the biasing force is decreased in response to the spring being decompressed.

9. The printhead pressure adjustment assembly of claim 1, wherein the adjustment assembly is supported by a toggle assembly.

10. The printhead pressure adjustment assembly of claim 9, wherein the toggle assembly is configured to be toggled between an engaged position and a disengaged position.

11. A printhead pressure adjustment assembly comprising:
- a barrel defining an internally threaded bore;
- a threaded insert disposed within the barrel, wherein the threaded insert defines an external thread configured to engage the internally threaded bore of the barrel;
- a biasing element configured to apply a biasing force to a printhead; and
- a spring coupled to the threaded insert, wherein the spring is compressed, increasing the biasing force, in response to the barrel being rotated in a first direction, and wherein the spring is decompressed, decreasing the biasing force, in response to the barrel being rotated in a second direction, opposite the first direction.

12. The printhead pressure adjustment assembly of claim 11, wherein the threaded insert is configured to remain rotationally fixed as the barrel is rotated.

13. The printhead pressure adjustment assembly of claim 11, wherein the biasing force is configured to be adjustable between about 3.5 pounds-force and 9.3 pounds-force.

14. The printhead pressure adjustment assembly of claim 11, further comprising a friction element configured to provide a friction force to resist rotation of the barrel.

15. The printhead pressure adjustment assembly of claim 11, wherein the barrel comprises an external rotation stop configured to limit rotation of the barrel to less than 360 degrees.

16. The printhead pressure adjustment assembly of claim 11, wherein the printhead pressure adjustment assembly is configured to be rotated between an engaged position in which the biasing element is engaged with a printhead, and a disengaged position in which the biasing element is disengaged with the printhead.

17. The printhead pressure adjustment assembly of claim 16, further comprising a base plate configured to retain the biasing element within the barrel in response to the printhead pressure adjustment assembly being moved to the disengaged position.

18. A printer comprising:
- a printhead assembly;
- a printhead pressure adjustment assembly configured to apply pressure to the printhead assembly, the printhead pressure adjustment assembly comprising:
  - an internally threaded barrel configured to rotate about an axis, wherein the barrel comprises biasing pressure level demarcations arranged around a perimeter of the barrel;
  - a threaded insert comprising external threads, wherein the external threads of the threaded insert engage the internal threads of the barrel;
  - a biasing element received within the barrel and configured to apply a biasing force generally along the axis to the printhead assembly, wherein the biasing force applied to the printhead is adjustable in response to the barrel being rotated; and a spring arranged to apply the biasing force to the biasing element, wherein the spring is compressed and the biasing force is increased in response to the barrel being rotated in a first direction, and wherein the spring is decompressed and the biasing force is decreased in response to the barrel being rotated in a second direction, opposite the first direction.

19. The printer of claim 18, wherein the printhead pressure adjustment assembly is configured to toggle between an engaged position in which the printhead pressure adjustment assembly applies pressure to the printhead assembly, and a disengaged position, in which the printhead pressure adjustment assembly does not apply pressure to the printhead assembly.

* * * * *